US008308096B2

(12) United States Patent
Mirchandani et al.

(10) Patent No.: US 8,308,096 B2
(45) Date of Patent: Nov. 13, 2012

(54) REINFORCED ROLL AND METHOD OF MAKING SAME

(75) Inventors: Prakash K. Mirchandani, Houston, TX (US); Morris E. Chandler, Santa Fe, TX (US)

(73) Assignee: TDY Industries, LLC, Pittsburgh, PA (US)

( * ) Notice: Subject to any disclaimer, the term of this patent is extended or adjusted under 35 U.S.C. 154(b) by 548 days.

(21) Appl. No.: 12/502,277

(22) Filed: Jul. 14, 2009

(65) Prior Publication Data

US 2011/0011965 A1 Jan. 20, 2011

(51) Int. Cl.
*B02C 7/04* (2006.01)
*B02C 13/20* (2006.01)

(52) U.S. Cl. ..... 241/235; 241/291; 241/293

(58) Field of Classification Search ..... 241/291, 241/301, 235, 293
See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,246,237 | A | 6/1941 | Benninghoff |
| 2,283,280 | A | 5/1942 | Nell |
| 2,299,207 | A | 10/1942 | Bevillard |
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |

(Continued)

FOREIGN PATENT DOCUMENTS

| | | |
|---|---|---|
| AU | 695583 | 2/1998 |

(Continued)

OTHER PUBLICATIONS

Metals Handbook, vol. 16 Machining, "Cemented Carbides" (ASM International 1989), pp. 71-89.

(Continued)

*Primary Examiner* — Bena Miller
(74) *Attorney, Agent, or Firm* — K & L Gates LLP; Patrick J. Viccaro; John E. Grosselin, III

(57) ABSTRACT

An article in the form of one of a plate, a sheet, a cylinder, and a portion of a cylinder, which is adapted for use as at least a portion of a wear resistant working surface of a roll is disclosed. The article includes a metal matrix composite comprising a plurality of inorganic particles dispersed in a matrix material. The matrix material includes at least one of a metal and a metal alloy, wherein the melting temperature of the inorganic particles is greater than the melting temperature of the matrix material. A plurality of hard elements are embedded in the metal matrix composite. The wear resistance of the metal matrix composite is less than the wear resistance of the hard elements, and the metal matrix composite preferentially wears away when the article is in use, thereby providing or preserving gaps between each of the plurality of hard elements at a working surface of the article.

24 Claims, 9 Drawing Sheets

U.S. PATENT DOCUMENTS 3,041,641 A 7/1962 Hradek et al.
3,093,850 A 6/1963 Kelso
3,368,881 A 2/1968 Abkowitz et al.
3,471,921 A 10/1969 Feenstra
3,490,901 A 1/1970 Hachisuka et al.
3,581,835 A 6/1971 Stebley
3,629,887 A 12/1971 Urbanic
3,660,050 A 5/1972 Iler et al.
3,757,879 A 9/1973 Wilder et al.
3,776,655 A 12/1973 Urbanic
3,782,848 A 1/1974 Pfeifer
3,806,270 A 4/1974 Tanner et al.
3,812,548 A 5/1974 Theuerkaue
RE28,645 E 12/1975 Aoki et al.
3,942,954 A 3/1976 Frehn
3,987,859 A 10/1976 Lichte
4,009,027 A 2/1977 Naidich et al.
4,017,480 A 4/1977 Baum
4,047,828 A 9/1977 Makely
4,094,709 A 6/1978 Rozmus
4,097,180 A 6/1978 Kwieraga
4,097,275 A 6/1978 Horvath
4,106,382 A 8/1978 Salje et al.
4,126,652 A 11/1978 Oohara et al.
4,128,136 A 12/1978 Generoux
4,170,499 A 10/1979 Thomas et al.
4,198,233 A 4/1980 Frehn
4,221,270 A 9/1980 Vezirian
4,229,638 A 10/1980 Lichte
4,233,720 A 11/1980 Rozmus
4,255,165 A 3/1981 Dennis et al.
4,270,952 A 6/1981 Kobayashi
4,277,106 A 7/1981 Sahley
4,306,139 A 12/1981 Shinozaki et al.
4,311,490 A 1/1982 Bovenkerk et al.
4,325,994 A 4/1982 Kitashima et al.
4,327,156 A 4/1982 Dillon et al.
4,340,327 A 7/1982 Martins
4,341,557 A 7/1982 Lizenby
4,376,793 A * 3/1983 Jackson ..... 427/451
4,396,321 A 8/1983 Holmes
4,398,952 A 8/1983 Drake
4,478,297 A 10/1984 Radtke
4,499,048 A 2/1985 Hanejko
4,499,795 A 2/1985 Radtke
4,526,748 A 7/1985 Rozmus
4,547,104 A 10/1985 Holmes
4,547,337 A 10/1985 Rozmus
4,550,532 A 11/1985 Fletcher, Jr. et al.
4,552,232 A 11/1985 Frear
4,553,615 A 11/1985 Grainger
4,554,130 A 11/1985 Ecer
4,562,990 A 1/1986 Rose
4,574,011 A 3/1986 Bonjour et al.
4,587,174 A 5/1986 Yoshimura et al.
4,592,685 A 6/1986 Beere
4,596,694 A 6/1986 Rozmus
4,597,730 A 7/1986 Rozmus
4,604,106 A 8/1986 Hall
4,605,343 A 8/1986 Hibbs, Jr. et al.
4,609,577 A 9/1986 Long
4,630,693 A 12/1986 Goodfellow
4,642,003 A 2/1987 Yoshimura
4,649,086 A 3/1987 Johnson
4,656,002 A 4/1987 Lizenby et al.
4,662,461 A 5/1987 Garrett
4,667,756 A 5/1987 King et al.
4,686,080 A 8/1987 Hara et al.
4,686,156 A 8/1987 Baldoni, II et al.
4,694,919 A 9/1987 Barr
4,708,542 A 11/1987 Emanuelli
4,722,405 A 2/1988 Langford
4,729,789 A 3/1988 Ide et al.
4,743,515 A 5/1988 Fischer et al.
4,744,943 A 5/1988 Timm
4,749,053 A 6/1988 Hollingshead
4,752,159 A 6/1988 Howlett
4,752,164 A 6/1988 Leonard, Jr.
4,779,440 A 10/1988 Cleve et al.
4,809,903 A 3/1989 Eylon et al.
4,838,366 A 6/1989 Jones
4,861,350 A 8/1989 Phaal et al.
4,871,377 A 10/1989 Frushour
4,884,477 A 12/1989 Smith et al.
4,889,017 A 12/1989 Fuller et al.
4,899,838 A 2/1990 Sullivan et al.
4,919,013 A 4/1990 Smith et al.
4,923,512 A 5/1990 Timm et al.
4,956,012 A 9/1990 Jacobs et al.
4,968,348 A 11/1990 Abkowitz et al.
4,991,670 A 2/1991 Fuller et al.
5,000,273 A 3/1991 Horton et al.
5,030,598 A 7/1991 Hsieh
5,032,352 A 7/1991 Meeks et al.
5,041,261 A 8/1991 Buljan et al.
5,049,450 A 9/1991 Dorfman et al.
RE33,753 E 11/1991 Vacchiano et al.
5,067,860 A 11/1991 Kobayashi et al.
5,090,491 A 2/1992 Tibbitts et al.
5,092,412 A 3/1992 Walk
5,098,232 A 3/1992 Benson
5,110,687 A 5/1992 Abe et al.
5,112,162 A 5/1992 Hartford et al.
5,112,168 A 5/1992 Glimpel
5,116,659 A 5/1992 Glatzle et al.
5,127,776 A 7/1992 Glimpel
5,161,898 A 11/1992 Drake
5,174,700 A 12/1992 Sgarbi et al.
5,179,772 A 1/1993 Braun et al.
5,186,739 A 2/1993 Isobe et al.
5,203,513 A 4/1993 Keller et al.
5,203,932 A 4/1993 Kato et al.
5,232,522 A 8/1993 Doktycz et al.
5,266,415 A 11/1993 Newkirk et al.
5,273,380 A 12/1993 Musacchia
5,281,260 A 1/1994 Kumar et al.
5,286,685 A 2/1994 Schoennahl et al.
5,305,840 A 4/1994 Liang et al.
5,311,958 A 5/1994 Isbell et al.
5,326,196 A 7/1994 Noll
5,333,520 A 8/1994 Fischer et al.
5,348,806 A 9/1994 Kojo et al.
5,359,772 A 11/1994 Carlsson et al.
5,373,907 A 12/1994 Weaver
5,376,329 A 12/1994 Morgan et al.
5,423,899 A 6/1995 Krall et al.
5,433,280 A 7/1995 Smith
5,438,858 A 8/1995 Friedrichs
5,443,337 A 8/1995 Katayama
5,452,771 A 9/1995 Blackman et al.
5,467,669 A 11/1995 Stroud
5,479,997 A 1/1996 Scott et al.
5,480,272 A 1/1996 Jorgensen et al.
5,482,670 A 1/1996 Hong
5,484,468 A 1/1996 Östlund et al.
5,487,626 A 1/1996 Von Holst et al.
5,496,137 A 3/1996 Ochayon et al.
5,505,748 A 4/1996 Tank et al.
5,506,055 A 4/1996 Dorfman et al.
5,518,077 A 5/1996 Blackman et al.
5,525,134 A 6/1996 Mehrotra et al.
5,541,006 A 7/1996 Conley
5,543,235 A 8/1996 Mirchandani et al.
5,544,550 A 8/1996 Smith
5,560,440 A 10/1996 Tibbitts
5,570,978 A 11/1996 Rees et al.
5,580,666 A 12/1996 Dubensky et al.
5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.

5,635,247 A 6/1997 Ruppi
5,641,251 A 6/1997 Leins et al.
5,641,921 A 6/1997 Dennis et al.
5,662,183 A 9/1997 Fang
5,665,431 A 9/1997 Narasimhan
5,666,864 A 9/1997 Tibbitts
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,718,948 A 2/1998 Ederyd et al.
5,732,783 A 3/1998 Truax et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Günter et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,830,256 A 11/1998 Northrop et al.
5,851,094 A 12/1998 Strand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A 3/1999 Fang et al.
5,890,852 A 4/1999 Gress
5,897,830 A 4/1999 Abkowitz et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,988,953 A 11/1999 Berglund et al.
6,007,909 A 12/1999 Rolander et al.
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,086,003 A * 7/2000 Gunter et al. ..... 241/235
6,086,980 A 7/2000 Foster et al.
6,089,123 A 7/2000 Chow et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,287 B1 4/2001 Waldenström
6,217,992 B1 4/2001 Grab
6,220,117 B1 4/2001 Butcher
6,227,188 B1 5/2001 Tankala et al.
6,228,139 B1 5/2001 Oskarrson
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,395,108 B2 5/2002 Eberle et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 1/2003 Mirchandani et al.
6,544,308 B2 4/2003 Griffin et al.
6,562,462 B2 5/2003 Griffin et al.
6,576,182 B1 6/2003 Ravagni et al.
6,585,064 B2 7/2003 Griffin et al.
6,589,640 B2 7/2003 Griffin et al.
6,599,467 B1 7/2003 Yamaguchi et al.
6,607,693 B1 8/2003 Saito et al.
6,620,375 B1 9/2003 Tank et al.
6,638,609 B2 10/2003 Nordgren et al.
6,655,481 B2 12/2003 Findley et al.
6,685,880 B2 2/2004 Engström et al.
6,688,988 B2 2/2004 McClure
6,695,551 B2 2/2004 Silver
6,706,327 B2 3/2004 Blomstedt et al.
6,719,074 B2 4/2004 Tsuda et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,892,793 B2 5/2005 Liu et al.
6,899,495 B2 5/2005 Hansson et al.
6,918,942 B2 7/2005 Hatta et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,044,243 B2 5/2006 Kembaiyan et al.
7,048,081 B2 5/2006 Smith et al.
7,070,666 B2 7/2006 Druschitz et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Craig et al.
7,128,773 B2 10/2006 Liang et al.
7,147,413 B2 12/2006 Henderer et al.
7,207,750 B2 4/2007 Annanolli et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,270,679 B2 9/2007 Istephanous et al.
7,381,283 B2 6/2008 Lee et al.
7,384,413 B2 6/2008 Gross et al.
7,384,443 B2 6/2008 Mirchandani
7,410,610 B2 8/2008 Woodfield et al.
7,497,396 B2 3/2009 Splinter et al.
7,513,320 B2 4/2009 Mirchandani et al.
7,524,351 B2 * 4/2009 Hua et al. ..... 75/252
7,575,620 B2 * 8/2009 Terry et al. ..... 75/252
7,625,157 B2 12/2009 Prichard et al.
7,687,156 B2 3/2010 Fang
7,846,551 B2 12/2010 Fang et al.
8,007,922 B2 8/2011 Mirchandani et al.
2002/0004105 A1 1/2002 Kunze et al.
2003/0010409 A1 1/2003 Kunze et al.
2003/0041922 A1 3/2003 Hirose et al.
2003/0219605 A1 11/2003 Molian et al.
2004/0013558 A1 1/2004 Kondoh et al.
2004/0105730 A1 6/2004 Nakajima
2004/0129403 A1 7/2004 Liu et al.
2004/0228695 A1 11/2004 Clauson

| | | | |
|---|---|---|---|
| 2004/0234820 | A1 | 11/2004 | Majagi |
| 2004/0245022 | A1 | 12/2004 | Izaguirre et al. |
| 2004/0245024 | A1 | 12/2004 | Kembaiyan |
| 2005/0008524 | A1 | 1/2005 | Testani |
| 2005/0025928 | A1 | 2/2005 | Annanolli et al. |
| 2005/0084407 | A1 | 4/2005 | Myrick |
| 2005/0103404 | A1 | 5/2005 | Hsieh et al. |
| 2005/0117984 | A1 | 6/2005 | Eason et al. |
| 2005/0194073 | A1 | 9/2005 | Hamano et al. |
| 2005/0211475 | A1 | 9/2005 | Mirchandani et al. |
| 2005/0247491 | A1 | 11/2005 | Mirchandani et al. |
| 2005/0268746 | A1 | 12/2005 | Abkowitz et al. |
| 2006/0016521 | A1 | 1/2006 | Hanusiak et al. |
| 2006/0032677 | A1 | 2/2006 | Azar et al. |
| 2006/0043648 | A1 | 3/2006 | Takeuchi et al. |
| 2006/0060392 | A1 | 3/2006 | Eyre |
| 2006/0286410 | A1 | 12/2006 | Ahigren et al. |
| 2006/0288820 | A1 | 12/2006 | Mirchandani et al. |
| 2007/0042217 | A1 | 2/2007 | Fang et al. |
| 2007/0082229 | A1 | 4/2007 | Mirchandani et al. |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |
| 2007/0108650 | A1 | 5/2007 | Mirchandani et al. |
| 2007/0126334 | A1 | 6/2007 | Nakamura et al. |
| 2007/0163679 | A1 | 7/2007 | Fujisawa et al. |
| 2007/0193782 | A1 | 8/2007 | Fang et al. |
| 2007/0251732 | A1 | 11/2007 | Mirchandani et al. |
| 2007/0277646 | A1 * | 12/2007 | Terry et al. ..... 75/240 |
| 2008/0011519 | A1 | 1/2008 | Smith et al. |
| 2008/0101977 | A1 | 5/2008 | Eason et al. |
| 2008/0145686 | A1 | 6/2008 | Mirchandani et al. |
| 2008/0163723 | A1 | 7/2008 | Mirchandani et al. |
| 2008/0302576 | A1 | 12/2008 | Mirchandani et al. |
| 2009/0041612 | A1 | 2/2009 | Fang et al. |
| 2009/0136308 | A1 | 5/2009 | Newitt |
| 2009/0180915 | A1 | 7/2009 | Mirchandani et al. |
| 2009/0293672 | A1 | 12/2009 | Mirchandani et al. |
| 2010/0044114 | A1 | 2/2010 | Mirchandani et al. |
| 2010/0044115 | A1 | 2/2010 | Mirchandani |
| 2010/0290849 | A1 | 11/2010 | Mirchandani |
| 2010/0303566 | A1 | 12/2010 | Fang et al. |

FOREIGN PATENT DOCUMENTS

| | | | |
|---|---|---|---|
| CA | 2212197 | C | 10/2000 |
| EP | 0157625 | A2 | 10/1985 |
| EP | 0264674 | A2 | 4/1988 |
| EP | 0453428 | A1 | 10/1991 |
| EP | 0641620 | B1 | 2/1998 |
| EP | 0995876 | A2 | 4/2000 |
| EP | 1065021 | A1 | 1/2001 |
| EP | 1077783 | B1 | 2/2001 |
| EP | 1106706 | A1 | 6/2001 |
| EP | 0759480 | B1 | 1/2002 |
| EP | 1244531 | B1 | 10/2004 |
| EP | 1686193 | A2 | 8/2006 |
| FR | 2627541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2158744 | A | 11/1985 |
| GB | 2218931 | A | 11/1989 |
| GB | 2324752 | A | 11/1998 |
| GB | 2352727 | A | 2/2001 |
| GB | 2385350 | A | 8/2003 |
| GB | 2393449 | A | 3/2004 |
| GB | 2397832 | A | 8/2004 |
| GB | 2435476 | A | 8/2007 |
| JP | 51-124876 | A | 10/1976 |
| JP | 59-175912 | A | 10/1984 |
| JP | 60-172403 | A | 9/1985 |
| JP | 61-243103 | A | 10/1986 |
| JP | 62-063005 | A | 3/1987 |
| JP | 2-269515 | A | 11/1990 |
| JP | 5-50314 | A | 3/1993 |
| JP | H03-119090 | U | 6/1995 |
| JP | 8-120308 | A | 5/1996 |
| JP | H8-209284 | | 8/1996 |
| JP | 10219385 | A | 8/1998 |
| JP | 11-300516 | A | 11/1999 |
| JP | 2002-097885 | A | 4/2002 |
| JP | 02254144 | A | 9/2002 |
| JP | 2002-317596 | A | 10/2002 |
| JP | 2003-306739 | A | 10/2003 |
| JP | 2004-181604 | | 7/2004 |
| JP | 2004-190034 | A | 7/2004 |
| JP | 2005-111581 | A | 4/2005 |
| RU | 2135328 | C1 | 8/1999 |
| SU | 1292917 | A1 | 2/1987 |
| SU | 1350322 | | 11/1987 |
| WO | WO 92/05009 | A1 | 4/1992 |
| WO | WO 92/22390 | A1 | 12/1992 |
| WO | WO 98/28455 | A1 | 7/1998 |
| WO | WO 99/13121 | A1 | 3/1999 |
| WO | WO 00/43628 | A2 | 7/2000 |
| WO | WO 00/52217 | A1 | 9/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |
| WO | WO 2008/115703 | A1 | 9/2008 |
| WO | WO 2011/008439 | A2 | 1/2011 |

OTHER PUBLICATIONS

Shi et al., "Composite Ductility—The Role of Reinforcement and Matrix", TMS Meeting, Las Vegas, NV, Feb. 12-16, 1995, 10 pages.
Vander Vort, "Introduction to Quantitative Metallography", Tech Notes, vol. 1, Issue 5, published by Buehler, Ltd. 1997, 6 pages.
You Tube, "The Story Behind Kennametal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies, attached to Declaration of Prakash Mirchandani, Ph.D. as filed in U.S. Appl. No. 11/737,993 on Sep. 9, 2009.
Metals Handbook Desk Edition, definition of 'wear', 2nd Ed., J.R. Davis, Editor, ASM International 1998, p. 62.
McGraw-Hill Dictionary of Scientific and Technical Terms, 5th Edition, Sybil P. Parker, Editor in Chief, 1993, pp. 799, 800, 1933, and 2047.
ProKon Version 8.6, The Calculation Companion, Properties for W, Ti, Mo, Co, Ni and FE, Copyright 1997-1998, 6 pages.
TIBTECH Innovations, "Properties table of stainless steel, metals and other conductive materials", printed from http://www.tibtech.com/conductivity.php on Aug. 19, 2011, 1 page.
"Material: Tungsten Carbide (WC), bulk", MEMSnet, printed from http://www.memsnet.org/material/tungstencarbidewcbulk/ on Aug. 19, 2001, 1 page.

Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Restriction Requirement mailed Jul. 24, 2008 in U.S. Appl. No. 11/167,811.
Office Action mailed Oct. 21, 2008 in U.S. Appl. No. 11/167,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action mailed May 11, 2011 in U.S. Appl. No. 11/167,811.
Office Action mailed Jul. 22, 2011 in U.S. Appl. No. 11/167,811.
Office Action mailed Oct. 13, 2006 in U.S. Appl. No. 10/922,750.
Notice of Allowance mailed May 21, 2007 for U.S. Appl. No. 10/922,750.
Supplemental Notice of Allowability mailed Jul. 3, 2007 for U.S. Appl. No. 10/922,750.
Office Action mailed Mar. 19, 2009 in U.S. Appl. No. 11/737,993.
Office Action mailed Jun. 3, 2009 in U.S. Appl. No. 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Restriction Requirement mailed Sep. 17, 2010 in U.S. Appl. No. 12/397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed May 3, 2010 in U.S. Appl. No. 11/924,273.
Office Action mailed Oct. 14, 2010 in U.S. Appl. No. 11/924,273.
Office Action mailed Feb. 2, 2011 in U.S. Appl. No. 11/924,273.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Office Action mailed Jan. 16, 2008 in U.S. Appl. No. 10/903,198.
Examiner's Answer mailed Aug. 17, 2010 in U.S. Appl. No. 10/903,198.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Restriction Requirement mailed Aug. 4, 2010 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Office Action mailed Sep. 2, 2011 in U.S. Appl. No. 12/850,003.
Office Action mailed Aug. 29, 2011 in U.S. Appl. No. 12/476,738.
U.S. Appl. No. 13/207,478, filed Aug. 11, 2011.
US 4,966,627, 10/1990, Keshavan et al. (withdrawn).
Advisory Action mailed Jun. 29, 2009 in U.S. Appl. No. 10/903,198.
ASM Materials Engineering Dictionary, J. R. Davis, Ed., ASM International, Fifth printing (Jan. 2006), p. 98.
Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.
Deng, X. et al., "Mechanical Properties of a Hybrid Cemented Carbide Composite," International Journal of Refractory Metals and Hard Materials, Elsevier Science Ltd., vol. 19, 2001, pp. 547-552.
Gurland, J. *Quantitative Microscopy*, R.T. DeHoff and F.N. Rhines, eds., McGraw-Hill Book Company, New York, 1968, pp. 279-290.
Gurland, Joseph, "Application of Quantitative Microscopy to Cemented Carbides," Practical Applications of Quantitative Matellography, ASTM Special Technical Publication 839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Metals Handbook, vol. 16 Machining, "Tapping" (ASM International 1989), pp. 255-267.
Notice of Allowance issued on Jan. 27, 2009 in U.S. Appl. No. 11/116,752.
Notice of Allowance mailed Oct. 21, 2002 in U.S. Appl. No. 09/460,540.
Notice of Allowance issued on Nov. 13, 2008 in U.S. Appl. No. 11/206,368.
Notice of Allowance issued on Nov. 26, 2008 in U.S. Appl. No. 11/013,842.
Notice of Allowance issued on Nov. 30, 2009 in U.S. Appl. No. 11/206,368.
Notice of Allowance issued on Jan. 26, 2010 in U.S. Appl. No. 11/116,752.
Office Action (Advisory Action) mailed Mar. 15, 2002 in U.S. Appl No. 09/460,540.
Office Action (final) mailed Dec. 1, 2001 in U.S. Appl. No. 09/460,540 .
Office Action (non-final) mailed Jun. 1, 2001 in U.S. Appl. No. 09/460,540.
Office Action (non-final) mailed Jun. 18, 2002 in U.S. Appl. No. 09/460,540.
Office Action issued on Aug. 12, 2008 in U.S. Appl. No. 11/116,752.
Office Action issued on Jul. 9, 2009 in U.S. Appl. No. 11/116,752.
Office Action issued on Aug. 31, 2007 in U.S. Appl. No. 11/206,368.
Office Action issued on Feb. 28, 2008 in U.S. Appl. No. 11/206,368.
Office Action issued on Jan. 15, 2008 in U.S. Appl. No. 11/116,752.
Office Action issued on Jan. 16, 2007 in U.S. Appl. No. 11/013,842.
Office Action issued on Jan. 24, 2008 in U.S. Appl. No. 10/848,437.
Office Action issued on Jul. 16, 2008 in U.S. Appl. No. 11/013,842.
Office Action issued on Jul. 30, 2007 in U.S. Appl. No. 11/013,842.
Office Action mailed Apr. 30, 2009 in U.S. Appl. No. 11/206,368.
Office Action mailed Oct. 31, 2008 in U.S. Appl. No. 10/903,198.
Office Action mailed Apr. 17, 2009 in U.S. Appl. No. 10/903,198.
Peterman, Walter, "Heat-Sink Compound Protects the Unprotected," Welding Design and Fabrication, Sep. 2003, pp. 20-22.
Pre-Appeal Brief Conference Decision issued on May 14, 2008 in U.S. Appl. No. 10/848,437.
Pre-Appeal Conference Decision issued on Jun. 19, 2008 in U.S. Appl. No. 11/206,368.
Restriction Requirement issued on Sep. 8, 2006 in U.S. Appl. No. 10/848,437.
Sriram, et al., "Effect of Cerium Addition on Microstructures of Carbon-Alloyed Iron Aluminides," Bull. Mater. Sci., vol. 28, No. 6, Oct. 2005, pp. 547-554.
Tracey et al., "Development of Tungsten Carbide-Cobalt-Ruthenium Cutting Tools for Machining Steels" Proceedings Annual Microprogramming Workshop, vol. 14, 1981, pp. 281-292.
Underwood, *Quantitative Stereology* pp. 23-108 (1970).
U.S. Appl. No. 12/464,607, filed May 12, 2009.
U.S. Appl. No. 12/616,300, filed Nov. 11, 2009.

* cited by examiner

REINFORCED ROLL AND METHOD OF MAKING SAME

BACKGROUND OF THE TECHNOLOGY

1. Field of the Technology

The present disclosure is directed to rolls used for high pressure comminution of granular materials such as, for example, minerals and ores in high pressure grinding mills. More specifically, the disclosure is directed to articles adapted for use as wear resistant working surfaces of rolls and to methods of making the articles and rolls including the articles.

2. Description of the Background of the Technology

The comminution of granular materials such as, for example, minerals and ores, is often carried out between rolls in a high pressure grinding mill. High pressure grinding mills typically utilize a pair of opposed counter-rotating grinding rolls. The rotation axis of one of the grinding rolls is fixed, and the rotation axis of the second roll is floating. A hydraulic system connected to the floating roll controls the position of the floating roll relative to the fixed roll, providing pressure between the rolls and an adjustable grinding force on material passing between the rolls. The rotational speed of the rolls is also adjustable to optimize the grinding conditions. By controlling the gap between the rolls, the speed of the rolls, and the applied force, the ore or other materials passing between the rolls can be crushed in an efficient manner with relatively low energy input.

During high pressure grinding of granular materials, the material to be ground is fed into the gap between the rolls. The gap is referred to as the "nip", and also may be referred to as the "roll gap". The grinding of ore passing into the nip, for example, occurs by a mechanism of inter-particle breakage caused by the very high pressures developed within the material stream as it passes between the counter-rotating rolls. In addition, ore ground in this way exhibits cracks in the ore grains, which is beneficial to downstream processing of the ore.

As can be expected, the grinding operation exerts very high levels of mechanical stress on the grinding rolls of high pressure grinding apparatuses, and the grinding rolls may quickly wear.

One known approach to improve the wear resistance of a roll surface is by welding layers of hard metallic material onto the surface. FIG. 1 depicts a prior art grinding roll including a wear resistant welded surface layer. The welding process may be time consuming and expensive.

Another known approach to improve wear resistance of a grinding roll surface is by providing hard regions that project from the working surface of the roll. FIG. 2 depicts two views of a prior art roll including welded hard regions projecting from the working surface of the roll. The top view in FIG. 2 is a magnified view of the roll surface showing the individual projections and gaps between the projections. The gaps trap fine grains of the material being ground, providing autogenous wear protection to the roll surface.

U.S. Pat. Nos. 5,203,513 and 7,497,396 disclose rolls adapted for use in high pressure grinding mills and that include hard projections with gaps therebetween. As with the prior art roll depicted in FIG. 2, the gaps between the hard projections trap fine particles of the material being ground, and the particles provide autogenous wear protection to the roll surface. Also, friction between the trapped fine particles and the material being ground helps to draw the material to be ground into the nip. The method described in the '513 and '396 patents to fabricate the rolls essentially involves welding the hard projections onto the roll surface.

U.S. Pat. Nos. 6,086,003 and 5,755,033 also disclose rolls adapted for use in high pressure grinding mills that include hard projections and gaps between the projections. The method described in the '003 and '033 patents to fabricate the grinding rolls involves embedding hard bodies within a mass of metallic powder and consolidating the powder by hot isostatic pressing.

The methods for fabricating wear resistant high pressure rolls described in the above-identified patents are costly and tedious. For example, the use of a welding process to secure hard elements to a roll surface limits the range of materials from which the hard elements can be fabricated. Hot isostatic pressing of a large roll requires the use of expensive equipment, and a grinding roll fabricated by hot isostatic pressing cannot be repaired easily in the field.

Accordingly, there is a need for articles and methods improving the wear resistance of the working surface of grinding rolls. It is desirable that such articles and methods require relatively inexpensive equipment; allow a wide range of materials to be used as the projecting hard elements; permit tailoring of the base material used in the grinding roll; and permit easy repair of the roll surface in the field.

SUMMARY

According to one non-limiting aspect of the present disclosure, an article in the form of one of a plate, a sheet, a cylinder, and a portion of a cylinder, the article adapted for use as at least a portion of a wear resistant working surface of a roll, the article comprises a metal matrix composite comprising a plurality of inorganic particles dispersed in a matrix material comprising at least one of a metal and a metal alloy The melting temperature of the inorganic particles is greater than a melting temperature of the matrix material. A plurality of hard elements is interspersed in the metal matrix composite. In a non-limiting embodiment a wear resistance of the metal matrix composite is less than a wear resistance of the hard elements and the metal matrix composite may preferentially wear away when the article is in use, thereby providing or preserving a gap between each of the plurality of hard elements at a working surface of the article.

In a non-limiting embodiment, a method of making an article adapted for use as a wear resistant working surface of a roll includes positioning a plurality of hard elements in predetermined positions on a bottom surface of a mold. Each of the hard elements comprises a first end and an opposed second end. A substantially equidistance exists between the first end and the opposed second end. The opposed second end of each of the hard elements rests on the bottom surface of the mold, so as to partially fill a void space of the mold and defines an unoccupied volume in the mold. Inorganic particles may be added to the mold to at least partially fill the unoccupied volume and provide a remainder space between the inorganic particles and between the inorganic particles and the hard elements. A non-limiting embodiment includes heating the plurality of hard elements and the inorganic particles to an infiltrating temperature. The remainder space may be infiltrated with a matrix material comprising at least one of a molten metal and a molten metal alloy that has a melting temperature that is less than a melting temperature of the inorganic particles. The matrix material disposed in the remainder space is to solidify the matrix material and bind the hard elements and the inorganic particles in the article.

A certain aspect of the disclosure includes a grinding roll for the comminution of granular materials. In a non-limiting embodiment, a grinding roll may comprise a cylindrical core comprising an external surface, and at least one wear resistant article adapted for use as a wear resistant working surface of the grinding roll, which is removably attached to the external surface of the cylindrical core. The article may include a metal matrix composite comprising a plurality of inorganic particles dispersed in a matrix material comprising at least one of a metal and a metal alloy, and a plurality of hard elements interspersed in the metal matrix composite. The wear resistance of the metal matrix composite may be less than a wear resistance of the hard elements, and the metal matrix composite may preferentially wear away when the grinding roll is in use, thereby providing or preserving a gap between each of the plurality of hard elements at a surface of the article.

A method of one of manufacturing or maintaining a grinding roll may include providing a cylindrical core comprising a external surface, and removably attaching an embodiment of a wear resistant article disclosed herein to the external surface of the cylindrical core.

BRIEF DESCRIPTION OF THE DRAWINGS

The features and advantages of articles and methods described herein may be better understood by reference to the accompanying drawings in which.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the parts and methods according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Figure 3A:
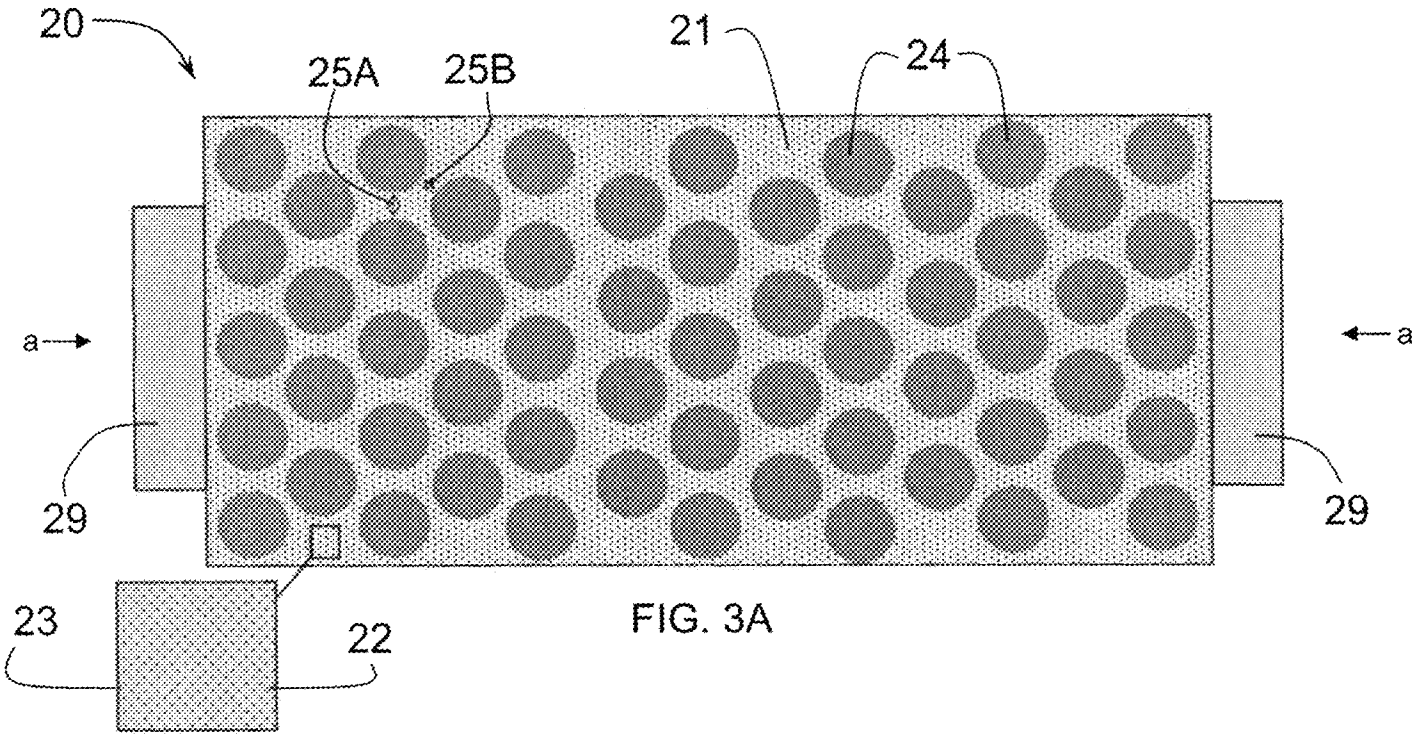
FIG. 3A is a schematic top view of a non-limiting embodiment of a wear resistant article according to the present disclosure.
Figure 3B:
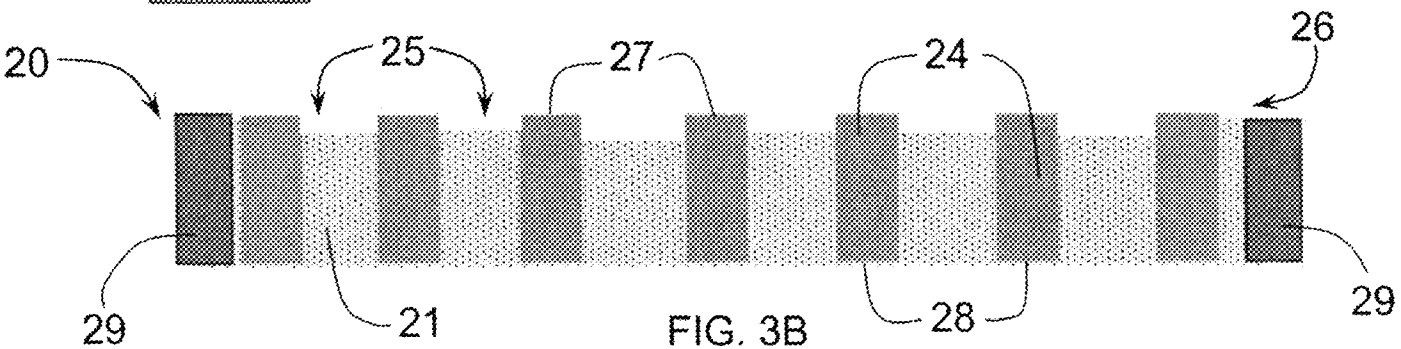
FIG. 3B is a schematic cross-section of a non-limiting embodiment of a wear resistant article according to the present disclosure, comprising spaced-apart hard elements protruding from a metal matrix composite.
Figure 3C:
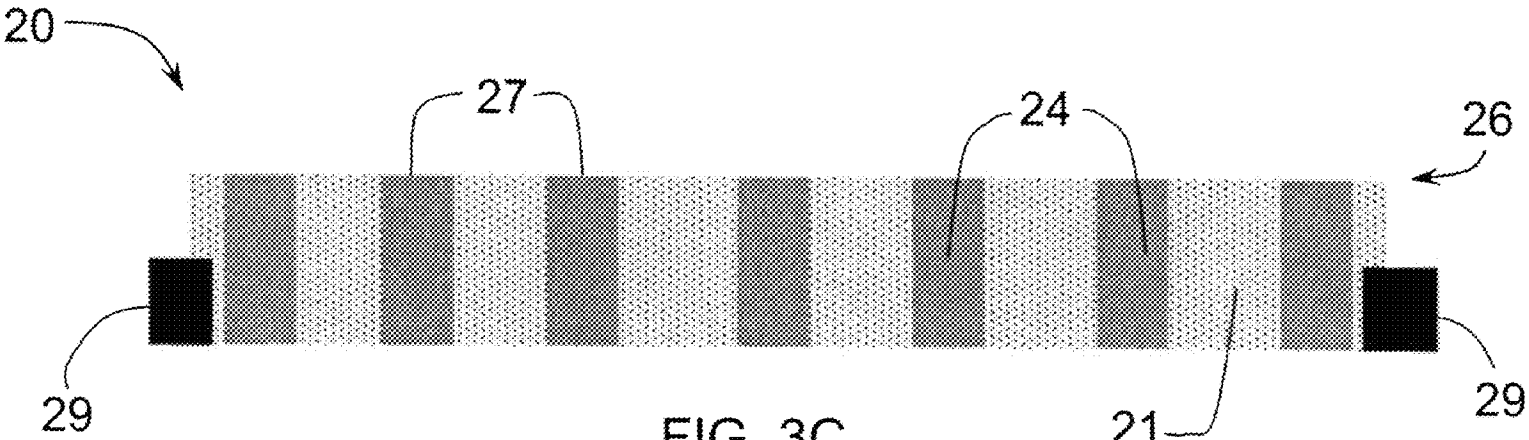
FIG. 3C is a schematic cross-section of a non-limiting embodiment of a wear resistant article according to the present disclosure, comprising spaced-apart hard elements with top surfaces that are substantially co-planar with a surface of a metal matrix composite.
Figure 3D:
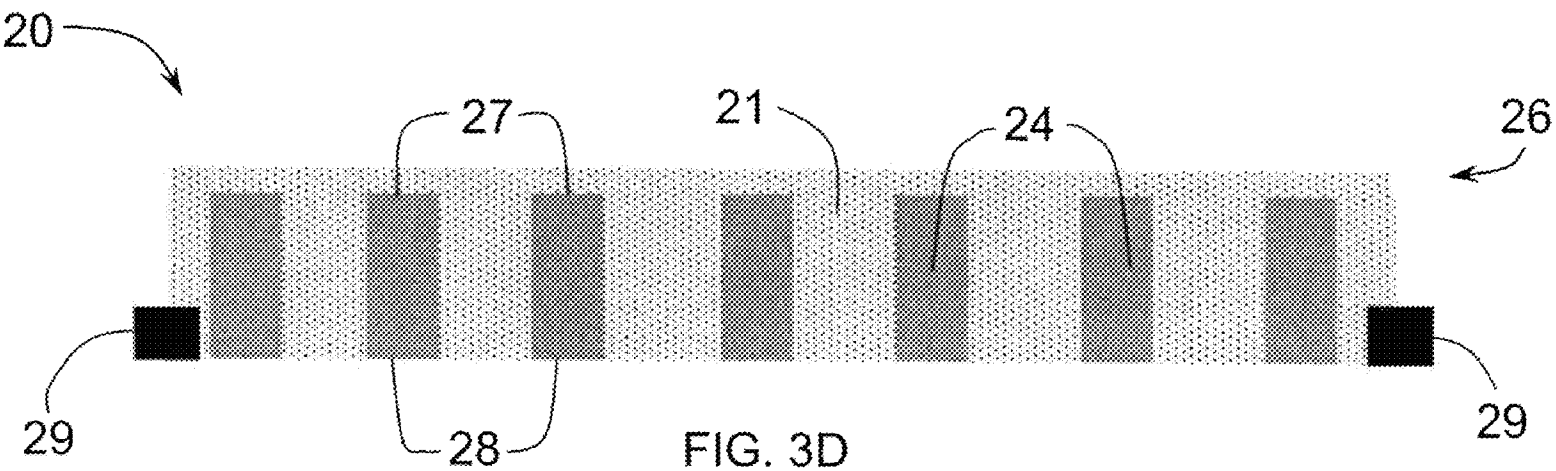
FIG. 3D is a schematic cross-section of a non-limiting embodiment of a wear resistant article according to the present disclosure, comprising hard elements with top surfaces that are covered with a metal matrix composite.

According to an aspect of this disclosure, FIGS. 3A, 3B, 3C, and 3D depict schematic representations of non-limiting embodiments of an article 20, in the form of a plate, adapted for us as a wear resistant working surface of a roll such as, but not limited to, a high pressure grinding roll adapted for the comminution of granular materials. As used herein, the "working surface" of a roll or other article is the surface of the article that contacts and exerts force on the material being processed. FIG. 3A is a schematic top view of the article 20. FIGS. 3B-3D are schematic cross-sections showing various aspects of an article 20 taken through line a-a on FIG. 3A.

Referring to FIGS. 3A-3B, non-limiting embodiments of an article 20 encompassed by an aspect of this disclosure comprise a metal matrix composite 21 comprising a plurality of inorganic particles 22 dispersed and embedded in a metallic (i.e., metal-containing) matrix material 23. In certain embodiments, the matrix material 23 comprises at least one of a metal and a metal alloy. Also, in certain embodiments, the melting temperature of the inorganic particles 22 is greater than the melting temperature of the matrix material 23. While FIGS. 3A-3D suggest a uniform distribution of the inorganic particles 22 dispersed in the matrix material 23, it is understood that FIGS. 3A-3D are non-limiting schematic representations useful in the understanding of embodiments disclosed herein and are not exhaustive of all embodiments according to the present disclosure. For example, although the inorganic particles 22 may be homogenously distributed in the matrix material 23, it is not necessarily the case that the inorganic particles 22 are dispersed in the regular fashion depicted in the schematic representations of FIGS. 3A-3D.

A plurality of hard elements 24 are interspersed within the article 20. In an embodiment, the wear resistance of the metal matrix composite 21 is less than the wear resistance of the hard elements 24. In such case, as shown in FIG. 3B, as the metal matrix composite 21 wears away during use, gaps 25 are created between each of the plurality of hard elements 24 at the working surface 26 of the article 20. It is recognized, however, that the gaps 25 also can be partially or fully formed during the manufacture of the article 20.

In certain non-limiting embodiments, each of the hard elements may comprise at least one of a high hardness metal, a high hardness metal alloy, a sintered cemented carbide, and a ceramic material. The terms "high hardness metal" and "high hardness metal alloy" are defined herein as a wear resistant metal or metal alloy, respectively, having a bulk hardness equal to or greater than 40 HRC, as determined by the Rockwell hardness test, and measured according to the Rockwell C scale. In another non-limiting embodiment, the bulk hardness of the high hardness metal or high hardness metal alloy may be equal or greater than 45 HRC, as determined by the Rockwell hardness test. Examples of high hardness metal alloys include, but are not limited to, tool steels. In embodiments wherein the hard elements 24 comprise a ceramic material, the ceramic material is a wear resistant ceramic material and may be selected from, but is not limited to, the group of ceramic material including silicon nitride and aluminum oxide reinforced with silicon carbide whiskers.

In another non-limiting embodiment, one or more of the hard elements 24 may include a sintered cemented carbide. Non-limiting examples of sintered cemented carbides that may be used for the hard elements disclosed herein are cemented carbides comprising particles of at least one carbide of a Group IVB, a Group VB, and a Group VIB metal of the Periodic Table dispersed in a continuous binder comprising at least one of cobalt, a cobalt alloy, nickel, a nickel alloy, iron, and an iron alloy. Those skilled in the art are familiar with grades of cemented carbide powders that, when processed, provide sintered cemented carbides having high strength and wear resistance, and the sintered cemented carbides produced from such grades may be used to form certain non-limiting embodiments of the hard elements 24 disclosed herein. Exemplary grades of cemented carbide powders useful in preparing sintered cemented carbide hard elements 24 that may be used in non-limiting embodiments of wear resistant articles according to the present disclosure include, but are not limited to, Grade AF63 and Grade 231 available from ATI Firth Sterling, Madison, Ala.

In certain non-limiting embodiments according to the present disclosure, the hard elements are positioned and spaced apart in a predetermined pattern. In certain non-limiting embodiments, the pattern of hard elements may be periodic and conform to a regular lattice-type structure, or may be in irregular or aperiodic arrangements, which do not conform to a regular lattice structure. A non-limiting embodiment of a pattern of a periodic arrangement of hard elements that may be used in an article according to the present disclosure is depicted in FIG. 3A. Other patterns may include repeating squares, triangles, and the like. A spaced-apart arrangement of hard elements 24 in an article according to the present disclosure also results in a corresponding arrangement of gaps 25 between the hard elements 24.

For the efficient and economical operation of high pressure grinding mills, for example, the working surface of the rolls must be resistant to wear and abrasion and must efficiently draw the material to be comminuted into the nip. Referring again to FIGS. 3A and 3B, in certain non-limiting embodiments of an article 20 according to the present disclosure adapted for use as a wear resistant working surface of a grinding roll, the gaps 25 between the hard elements 24 are regions in which fine particles ("fines") of the material being ground are trapped. Friction between the fine particles trapped in the gaps 25 and the material to be ground helps to draw the material to be ground into the nip. The hard elements 24 and the trapped fines in the gaps 25, and any exposed metal matrix composite 21 provide autogenous wear protection. Additional wear protection is provided by the metal matrix composite 21 underlying the fines trapped in the gaps 25.

Any of the shape of the hard elements 24, the average distance between adjacent hard elements 24, i.e., the average gap distance, and the average size of the hard elements 24 of the article 20 can be varied to impart different characteristics to the working surface of a grinding roll and thereby influence the comminution process. In addition, the gaps 25 between the hard elements 24 collect fine particles, i.e., ground fines, which provide a protective surface over the matrix material 23. The ground fines collected in the gaps 25 provide an exposed surface that is rougher than the any exposed surface of the hard elements 24, and thereby serve to provide areas of higher friction, which aids in drawing the material to be comminuted (ground) into the nip. If the gaps 25 are too small, the fines will tend not to accumulate in the gaps. If the gaps 25 are too large, a compact cake of the fines will not form in the gaps 25. In the non-limiting embodiment depicted in FIG. 3A, the average gap distance is the average length of lines 25A and 25B. In one non-limiting embodiment, the average gap distance may range from 5 mm (0.2 inch) to 50 mm (2 inch). In another non-limiting embodiment, the average gap distance may range from 10 mm (0.4 inch) to 40 mm (1.6 inch). It is recognized that these average gap distances are directed to non-limiting embodiments of articles according to the present disclosure, and that other average gap distance values may be beneficial for particular applications.

In one non-limiting exemplary embodiment of an article 20 according to the present disclosure adapted for use as a wear resistant working surface of a roll, the pattern of the hard elements 24 may be similar to the pattern schematically depicted in FIG. 3A, and the hard elements 24 may be in the form of cylinders with substantially planar end surfaces. In certain non-limiting embodiments, an average diameter of the hard elements 24 may range from 10 mm (0.4 inch) to 40 mm (1.6 inch). In other non-limiting embodiments, an average diameter of the hard elements 24 may range from 15 mm (0.6 inch) to 35 mm (1.4 inch). It is recognized that these average hard element shapes, distributions, and diameters are directed to non-limiting embodiments of articles according to the present disclosure, and that other shapes, distributions and/or diameters may be beneficial for particular applications.

It will be understood that the hard elements 24 may be in a form different from a cylinder and/or have ends that are non-planar, and that the hard elements 24 may not be of a uniform shape. For example, in certain embodiments the hard elements may be in the shape of a cube or a cuboid, wherein the values for the average hard element diameters provided above may be, for example, the average diagonal or average edge length of a face of the cube or cuboid. A person skilled in the art will understand that hard elements 24 having other three-dimensional shapes are within the scope of embodiments disclosed herein, so long as a plurality of gaps 25 are provided between a plurality of the hard elements 24, either initially or, as discussed herein below, through preferential wear of the metal matrix composite when the article is in use.

According to one non-limiting embodiment, the hard elements 24 comprise 25% to 95% of a projected surface area of the surface of the article 20. In other non-limiting embodiments, the hard elements 24 comprise 40% to 90%, or 50% to 80% of the projected surface area. It will be understood, however, that the hard elements may comprise any fraction of the projected surface area of the hard elements suitable for the intended application of the article 20. The term "projected surface area" is defined herein as the two dimensional projection of the total surface area of the metal matrix composite 21 exposed at the working surface 26 of the article 20 and the total surface area of the first ends 27 of the hard elements 24 (discussed below) exposed at the working surface 26.

Referring to FIG. 3B, a first end 27 of a hard element 24 is exposed on the working surface 26 of the article 20. The first ends 27 of the hard elements 24 in FIG. 2B comprises a circular shape but, as discussed hereinabove, in other non-limiting embodiments the first ends 27 of the hard elements 24 may comprise a square shape, a rectangular shape, a polygonal shape, a complex curved shape, a shape having curved and linear portions, or any other shape suitable for use in grinding the particular granular material to be processed. In different non-limiting embodiments, the first ends 27 of the hard elements 24 may be substantially planar, may be curved, may include planar and curved regions, or may have a complex planar and/or non-planar geometry. In some non-limiting embodiments, the first ends 27 of the hard elements 24 may include points, ridges, and/or other features. It will be understood that the opposed second end 28 of a hard element 24 also may have any or all of the above possible physical characteristics of the first end 27. Generally, however, the ends 27 and 28 may be the same or different and may have any characteristics suitable for the intended application of the article 20.

Referring to FIGS. 3B-3D, in certain non-limiting embodiments, the hard elements 24 of the article 20 may comprise a first end 27 and a opposed second end 28, wherein the first end 27 and opposed second end 28 are on opposite ends of a hard element 24. In certain embodiments, the first end and the opposed second end 27, 28 of each article are equidistant. In the article 20 illustrated in FIGS. 3C and 3D, the first ends 27 of the hard elements 24 are depicted as not projecting beyond the metal matrix composite 21 on the working surface 26 of the article 20 and, therefore, no gaps (such as gaps 25) are depicted on the working surface 26 between the hard elements 24. FIGS. 3C and 3D depict possible non-limiting embodiments of article 20 immediately after manufacture, wherein the first ends 27 of the depicted hard elements 24 either are substantially co-planar with the surface of the metal matrix composite 21 at the working surface 26 (FIG. 3C) or are embedded within (covered by) the metal matrix composite 21 (FIG. 3D). Because the wear resistance of the matrix composite 21 is less than the wear resistance a hard element 24, the metal matrix composite 21 will wear away more quickly than the hard elements 24 during use, which will tend to expose the first end 27 and then the side surface(s) of the hard elements 24 in an incremental fashion during use. For example, an article 20 manufactured in the form shown in FIG. 3D may transform to the form shown in FIG. 3C, and then to the form shown in FIG. 3B as the metal matrix composite 21 preferentially wears away and exposes the ends 27 and then progressively more of the side surface of the hard elements 24. As the metal matrix composite 21 wears away, the gaps 25 shown in FIG. 3B are created. Once gaps 25 have been created, fines disposed in the gaps may aid in inhibiting wear of the underlying metal matrix composite 21 and/or aid in drawing material to be processed into the nip. It is recognized by a person skilled in the art that a working surface may be located at the opposed second ends 28, because the article 20 in the form of a plate is substantially symmetrical.

In a non-limiting embodiment, the first end 27 and the opposed second end 28 of a hard element 24 are substantially planar and substantially parallel to each other. In one non-limiting embodiment, each of the hard elements 24 comprises a cylindrical shape and the first end 27 and the opposed second end 28 of a hard element 24 are substantially planar and substantially parallel to each other. In yet another non-limiting embodiment, each of the hard elements 24 comprises a cylindrical shape and the first end 27 and the opposed second end 28 of each hard element 24 exhibits a curvature. In still another non-limiting embodiment, each of the hard elements 24 comprises a cylindrical shape and one of the first end 27 and the opposed second end 28 is substantially planar, while the other of the first end 27 and the opposed second end 28 exhibits a curvature.

According to a non-limiting aspect of this disclosure, certain embodiments of the metal matrix composite 21 comprise inorganic particles 22 having an average particle size ranging from 0.5 μm to 250 μm. In other non-limiting embodiments, the inorganic particles 22 may have an average particle size ranging from 2 μm to 200 μm. In the various embodiments, the metal matrix composite 21 binds the hard elements 24 into the article 20.

In certain non-limiting embodiments according to the present disclosure, the inorganic particles 22 of the metal matrix composite 21 may comprise at least one of a metal powder and a metal alloy powder. In certain non-limiting embodiments, the metal or metal alloy powder of the metal matrix composite 21 comprises at least one of tungsten, a tungsten alloy, tantalum, a tantalum alloy, molybdenum, a molybdenum alloy, niobium, a niobium alloy, iron, an iron alloy, titanium, a titanium alloy, nickel, a nickel alloy, cobalt, and a cobalt alloy.

In another non-limiting embodiment according to the present disclosure, the inorganic particles 22 of the metal matrix composite 21 may comprise hard particles. The term "hard particles" is defined herein as inorganic particles exhibiting a hardness of at least 60 HRC, as measured by the Rockwell hardness test using scale C. A non-limiting embodiment of the metal matrix composite 21 includes inorganic particles 22 comprising at least one of a carbide, a boride, an oxide, a nitride, a silicide, a sintered cemented carbide, a synthetic diamond, and a natural diamond. In yet another non-limiting embodiment, the inorganic particles 21 comprise at least one of: a carbide of a metal selected from Groups IVB, VB, and VIB of the Periodic Table of the Elements; tungsten carbide; and cast tungsten carbide.

As noted above, the matrix material 23 of certain non-limiting embodiments comprises at least one of a metal and a metal alloy. In a non-limiting embodiment, the matrix material 23 includes at least one of copper, a copper alloy, aluminum, an aluminum alloy, iron, an iron alloy, nickel, a nickel alloy, cobalt, a cobalt alloy, titanium, a titanium alloy, a bronze alloy, and a brass alloy. In one non-limiting embodiment, the matrix material 23 is a bronze alloy consisting essentially of 78 weight percent copper, 10 weight percent nickel, 6 weight percent manganese, 6 weight percent tin, and incidental impurities. In another non-limiting embodiment, the matrix material consists essentially of 53 weight percent copper, 24 weight percent manganese, 15 weight percent nickel, 8 weight percent zinc, and incidental impurities. In non-limiting embodiments, the matrix material 23 may include up to 10 weight percent of an element that will reduce the melting point of the matrix material, such as, but not limited to at least one of boron, silicon, and chromium.

A non-limiting aspect of the article 20 according to the present disclosure includes providing the article 20 with at least one machinable region 29. In certain non-limiting embodiments, a machinable region 29 may comprise a region of metal or metal alloy joined to the article 20 by the metal matrix composite 21. Non-limiting embodiments of a machinable region 29 may include a metal or a metal alloy comprising at least one of iron, an iron alloy, nickel, a nickel alloy, cobalt, a cobalt alloy, copper, a copper alloy, aluminum, an aluminum alloy, tantalum, and a tantalum alloy. In yet other non-limiting embodiments, a machinable region 29 of the article 20 may include particles of a machinable metal joined together by the matrix material 23 included in the metal matrix composite 21. In certain non-limiting embodiments, the particles of a machinable metal included in the machinable region 29 may include at least one of iron, an iron alloy, nickel, a nickel alloy, cobalt, a cobalt alloy, copper, a copper alloy, aluminum, an aluminum alloy, tantalum, and a tantalum alloy. A machinable region 29 of the article 20 may be adapted for fixturing (i.e., connecting) the article 20 to a peripheral surface of a roll (see FIG. 7) adapted to grind, pulverize, comminute, or otherwise process granular materials. For example, the roll may be a roll of a high pressure grinding mill adapted for comminuting granular materials. The machinable region 29 may be machined to include features facilitating fixturing the article 20 to a peripheral surface of a roll. Machining the machinable region 29 may include, but is not limited to, threading, drilling, and/or milling the machinable region 29.

Figure 4:
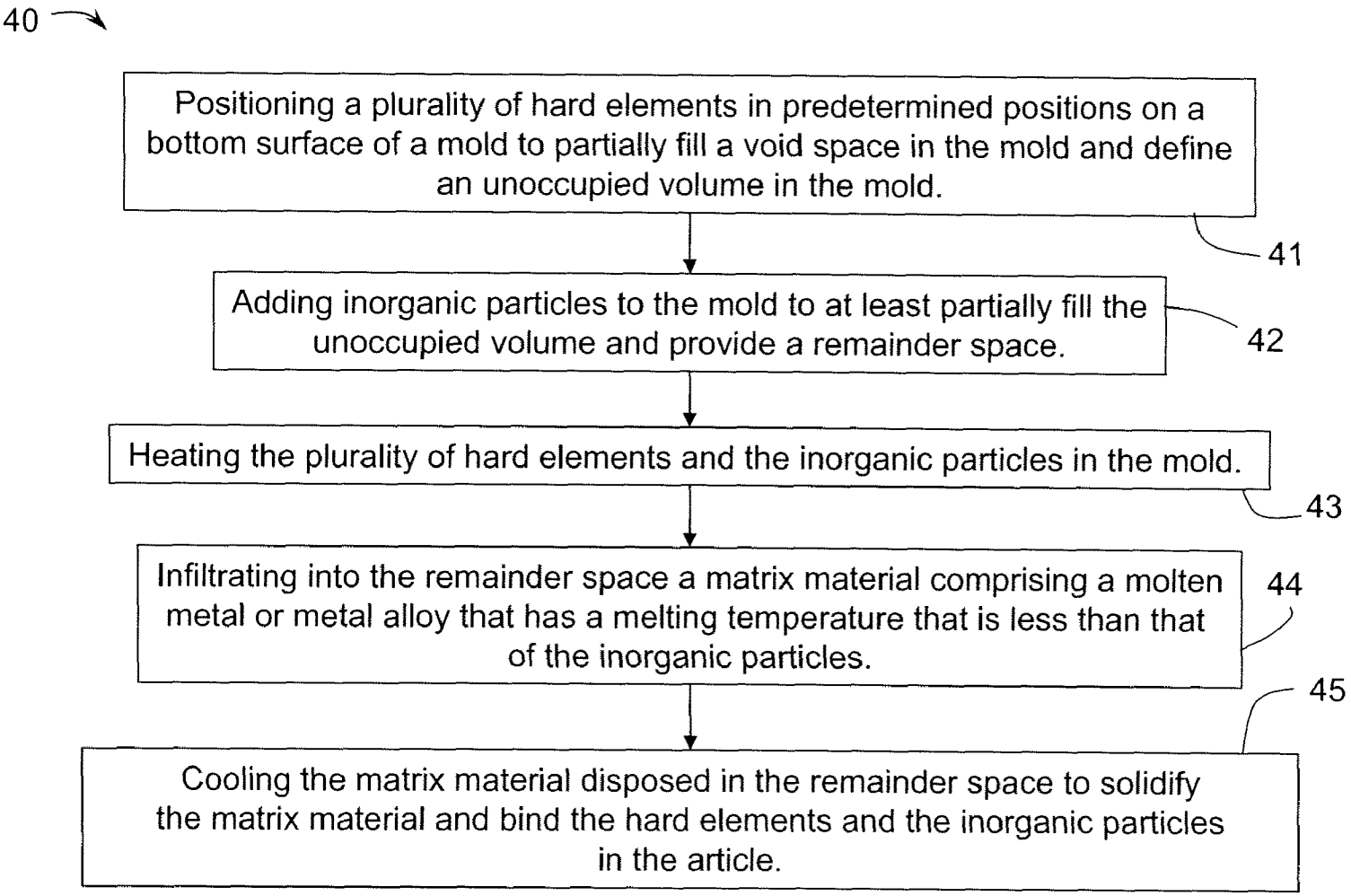
FIG. 4 is a flow chart illustrating one non-limiting embodiment of a method for manufacturing a wear resistant article according to the present disclosure adapted for use as a working surface of a roll.
Figures 5A, 5B, 5C:
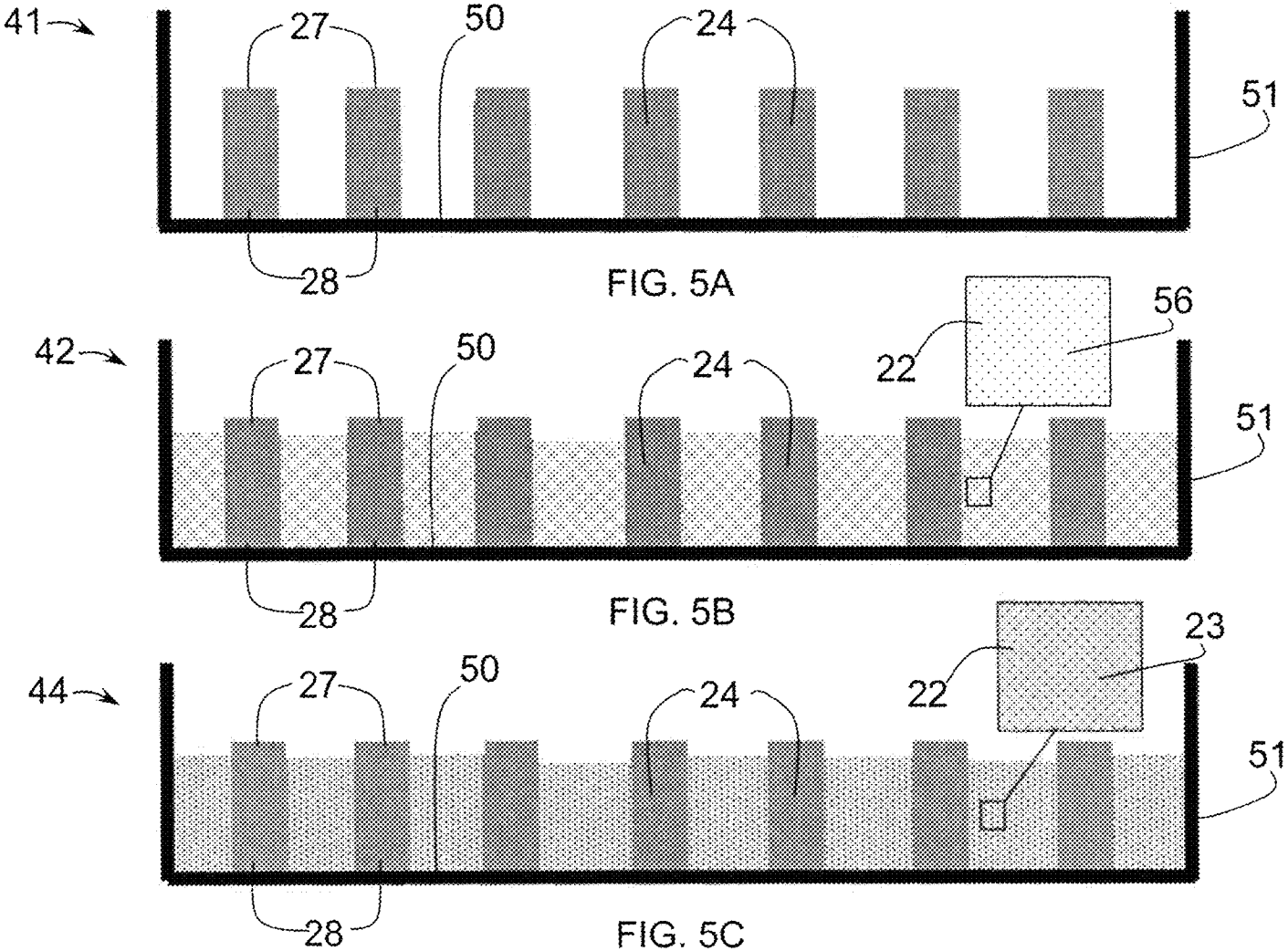
FIG. 5A schematically illustrates positioning hard elements in a mold as a step in a non-limiting embodiment of a method of making a wear resistant article according to the present disclosure.
FIG. 5B schematically illustrates adding inorganic particles to a mold as a step in a non-limiting embodiment of a method of making a wear resistant article according to the present disclosure.
FIG. 5C schematically illustrates infiltrating a matrix material as a step in a non-limiting embodiment of a method of making a wear resistant article according to the present disclosure.

One non-limiting embodiment of a method of making an article adapted for use as a wear resistant working surface of a roll, such as, for example, article 20, is depicted in the flow diagram of FIG. 4, and the cross-sections of FIGS. 5A-5C. The cross-sections of FIGS. 5A-5C correspond to sections taken at the line a-a in FIG. 2A. Referring to FIG. 2A, FIG. 4, and FIGS. 5A-5C, a non-limiting method 40 for making a wear resistant article according to the present disclosure includes positioning 41 a plurality of hard elements 24 on a bottom surface 50 of a mold cavity of a mold 51, so that an opposed second end 28 of each of the hard elements 24 rests on a bottom surface 50 of the mold cavity of the mold 51. The hard elements may or may not be positioned 41 in a predetermined pattern. In a non-limiting embodiment of the method according to the present disclosure, the opposed second end 28 and the first end 27 of each hard element 24 are substantially planar and are substantially parallel to one another and to the bottom surface 50 of the mold cavity of the mold 51.

The mold 51 may be machined from graphite or any other suitable chemically inert material that can withstand the processing temperatures of the methods disclosed herein without significantly warping or otherwise degrading. The mold 51 may be adapted to form a part that is in the shape of a plate, a sheet, a cylinder, a portion of a cylinder, or any other shape suitable to form all or a portion of a wear resistant working surface of a roll when fixtured to the roll. A plate mold or a sheet mold, for example, typically includes a mold cavity including a substantially planar bottom surface and four upward extending sidewalls.

Figure 6:
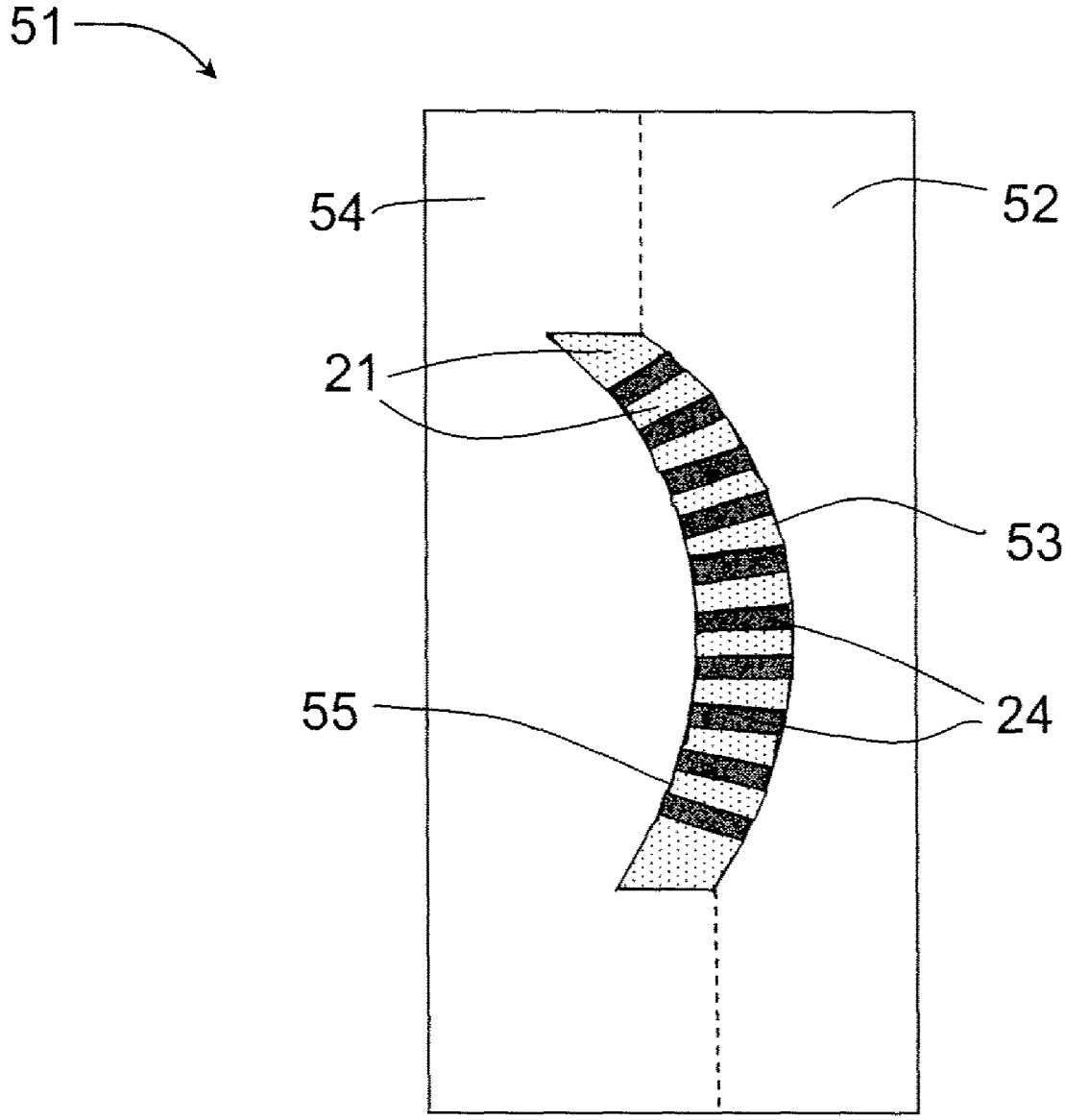
FIG. 6 is a schematic representation of top view of a non-limiting embodiment of a two piece vertical mold containing a non-limiting embodiment of a wear resistant article according the present disclosure.

A mold cavity of a mold adapted to form a cylindrical part or a part in the shape of a portion of a cylinder according to the present disclosure may include a bottom surface that conforms to the curvature of all or a portion of the cylindrical peripheral surface of a roll. A non-limiting embodiment of a mold 51 that may be used to form an article 20 having a curved surface is schematically depicted in FIG. 6. Referring to FIG. 6 and FIG. 3A, in a non-limiting embodiment, a curved mold 51 may comprise a vertical two-piece mold 51 having a first mold piece 52 including a first curved surface 53, and a second mold piece 54 including a second curved surface 55. In a non-limiting embodiment, hard elements 24 may be positioned on the first curved surface 53 of the first mold piece 52 when the first mold piece 52 is horizontally oriented. The second mold piece 54 may be mated with and secured to the first mold piece 52, holding the hard elements 24 in place in the mold cavity. The mold 51 may then be moved to a vertical position, a top view of which is depicted in FIG. 6. A plurality of inorganic particles 22 may be added to the mold cavity of the mold 51, between the hard elements 24. The mold 51 may then be infiltrated with the matrix material 23 to form a metal matrix composite 21 with the inorganic particles 22.

Although the foregoing embodiment utilizes a mold 51 having curved surfaces in the mold cavity to make a curved article, it will be understood that non-limiting embodiments of an article according to the present disclosure also may be made in flat forms, such as plates or sheets. For example, in certain non-limiting embodiments, the metal matrix composite 21 is ductile, and a wear resistant article 20 in the form of a plate or other flat form may be hot worked or otherwise suitably processed to provide a curvature to the article 20 that matches the curvature of the peripheral surface of a roll to which the article is to be attached.

The bottom surface 50 of a mold 51 used to form a wear resistant part according to the present disclosure may be further machined to accommodate the contours or shapes of the opposed second ends 28 of the hard elements 24 that are disposed in the mold cavity of the mold 51 and form regions of the part made using the mold 51. Also, machining contours or shapes in the mold may aid in positioning the hard elements 24. For example, the bottom surface 50 of a mold 51 may be machined to include contours such as, but not limited to, dimples to accommodate corresponding curved opposed second ends 28 of hard elements 24.

Following is a description of additional details of certain non-limiting embodiments of methods of making wear resistant articles according to the present disclosure, which will be better understood by reference to FIGS. 3A-D, 4, and 5A-C.

In one non-limiting embodiment of a method of making an article 20 according to the present disclosure, comprises positioning 41 in the mold cavity each of the hard elements 24, wherein the hard elements 24 each comprise a first end 27 and an opposed second end 28 and the distance between the ends 27 and 28 of each hard element 24 is the same or approximately the same (i.e., the ends 27 and 28 are substantially equidistant). In certain non-limiting embodiments of a method according to the present disclosure, the opposed second end 28 of each of the hard elements 24 rests on the bottom surface 50 of the mold cavity of the mold 51, so as to partially fill a void space in the mold cavity and thereby define an unoccupied volume 52 in the mold cavity, that is, the volume in the mold cavity that is not occupied by the hard elements 24.

Another aspect of a non-limiting embodiment of a method according to the present disclosure comprises adding 42 inorganic particles 22 to the mold cavity of the mold 30. The addition of inorganic particles 22 at least partially fills the unoccupied volume 52 and provides a remainder space (56 in the blown up section of FIG. 5B) in the mold cavity, that is, the space between the inorganic particles 22 themselves and any space between the inorganic particles 22 and the hard elements 24 within the mold cavity of the mold 30.

In a non-limiting embodiment, the plurality of hard elements 24 and the inorganic particles 22 disposed in the mold cavity of the mold 51 are heated 43 to an infiltrating temperature (defined below). Heating 43 can be achieved by heating the mold 51 containing the plurality of hard elements 24 and the inorganic particles 22 in a convection furnace, a vacuum furnace, or an induction furnace, by another induction heating technique, or by another suitable heating technique known to those having ordinary skill in the art. In certain embodiments, the heating can be conducted in atmospheric air, in an inert gas, or under vacuum.

Following heating 43, the remainder space 56 is infiltrated 44 with a matrix material 23 comprising at least one of a molten metal and a molten metal alloy that has a melting temperature that is less than a melting temperature of the inorganic particles 22. Infiltrating 44 the remainder space 56 is accomplished at the infiltrating temperature mentioned hereinabove. Thus, it will be understood that the infiltrating temperature is a temperature that is at least the melting temperature of the matrix material 23 that is infiltrated into the remainder space 56, but that is less than the melting temperature of the inorganic particles 22. In certain non-limiting embodiments, an infiltration temperature may range from 700° C. (1292° F.) for low melting temperature metals and alloys such as, for example, aluminum and aluminum alloys, to 1300° C. (2372° F.) for higher melting temperature metals and alloys such as, for example, copper, nickel, iron, cobalt, and alloys of any of these metals.

A further step of a non-limiting embodiment of a method according to the present disclosure includes cooling 45 the matrix material 23 disposed in the remainder space 56 to solidify the matrix material 23 and bind the hard elements 24 and the inorganic particles 22 in the article 20.

In certain non-limiting embodiments, positioning 41 the hard elements 24 comprises positioning 41 hard elements 24 that comprise at least one of a high hardness metal, a high hardness metal alloy, a sintered cemented carbide, and a ceramic. In yet another non-limiting embodiment, each of the hard elements 24 comprises a sintered carbide comprising particles of at least one carbide of a Group IVB, a Group VB, or a Group VIB metal of the Periodic Table of the Elements dispersed in a continuous binder comprising at least one of cobalt, a cobalt alloy, nickel, a nickel alloy, iron, and an iron alloy.

Adding 42 the inorganic particles 22 may include but is not limited to adding particles of a metal powder or a metal powder alloy. The metal powder or metal alloy powder may comprise at least one of tungsten, a tungsten alloy, tantalum, a tantalum alloy, molybdenum, a molybdenum alloy, niobium, a niobium alloy, iron, an iron alloy, titanium, a titanium alloy, nickel, a nickel alloy, cobalt, and a cobalt alloy.

In another non-limiting embodiment, adding 42 the inorganic particles 22 may include, but are not limited to, adding hard particles. Hard particles may include, but is not limited to, particles comprising at least one of a carbide of a metal selected from Groups IVB, VB, and VIB of the Periodic Table of the Elements; tungsten carbide, and cast tungsten carbide.

Infiltrating 44 with a matrix material 23 may include infiltrating into the remainder space a metal or metal alloy that has a melting temperature that is less than the melting temperature of the inorganic particles 22. The matrix material 23 may include, but is not limited to, at least one of copper, a copper alloy, aluminum, an aluminum alloy, iron, an iron alloy, nickel, a nickel alloy, cobalt, a cobalt alloy, titanium, a titanium alloy, a bronze alloy, and a brass alloy. In one non-limiting embodiment, the matrix material is a bronze alloy consisting essentially of 78 weight percent copper, 10 weight percent nickel, 6 weight percent manganese, 6 weight percent tin, and incidental impurities. In another non-limiting embodiment, the matrix material 23 consists essentially of 53 weight percent copper, 24 weight percent manganese, 15 weight percent nickel, 8 weight percent zinc, and incidental impurities.

Optionally, one of more machinable materials 29 may be positioned in the mold cavity of the mold 51 at predetermined positions. Positioning one or more machinable materials may include positioning one of more solid pieces comprising at least one of iron, iron alloy, nickel, nickel alloy, cobalt, cobalt alloy, copper, copper alloy, aluminum, aluminum alloy, tantalum, and tantalum alloy. In another non-limiting embodiment, positioning one or more machinable materials 29 comprises positioning a plurality of particles of at least one of a machinable metal and a machinable metal alloy in a region of the mold cavity, thereby creating a second remainder space between the particles of the machinable metal and/or a metal alloy. After heating the mold and the materials in the mold cavity to the infiltrating temperature, the matrix material is infiltrated into the second remainder space and is then cooled to form a solid machinable region of the part 20. The particles of a machinable metal and/or a machinable metal alloy may include, but are not limited to, particles of iron, iron alloy, nickel, nickel alloy, cobalt, cobalt alloy, copper, copper alloy, aluminum, aluminum alloy, tantalum, and tantalum alloy.

Certain embodiments of a method of making an article adapted for use as at least a portion of a wear resistant working surface of a roll include cleaning the article after it is formed. In some embodiments, an excess of material may be machined from the article to form a finished article that is of a desired size and configuration. In other embodiments, a finished article is obtained after the cooling 45 step.

Advantages of the methods for producing the wear resistant articles according to the present disclosure include, but are not limited to, the possibility of using relatively inexpensive equipment to make the articles, the possibility of using a wide range of materials to tailor the characteristics of the articles, and the possibility of incorporating one or more machinable regions on the article to facilitate attachment (fixturing) and detachment of the wear resistant articles from the peripheral surface of a roll.

Figure 7:
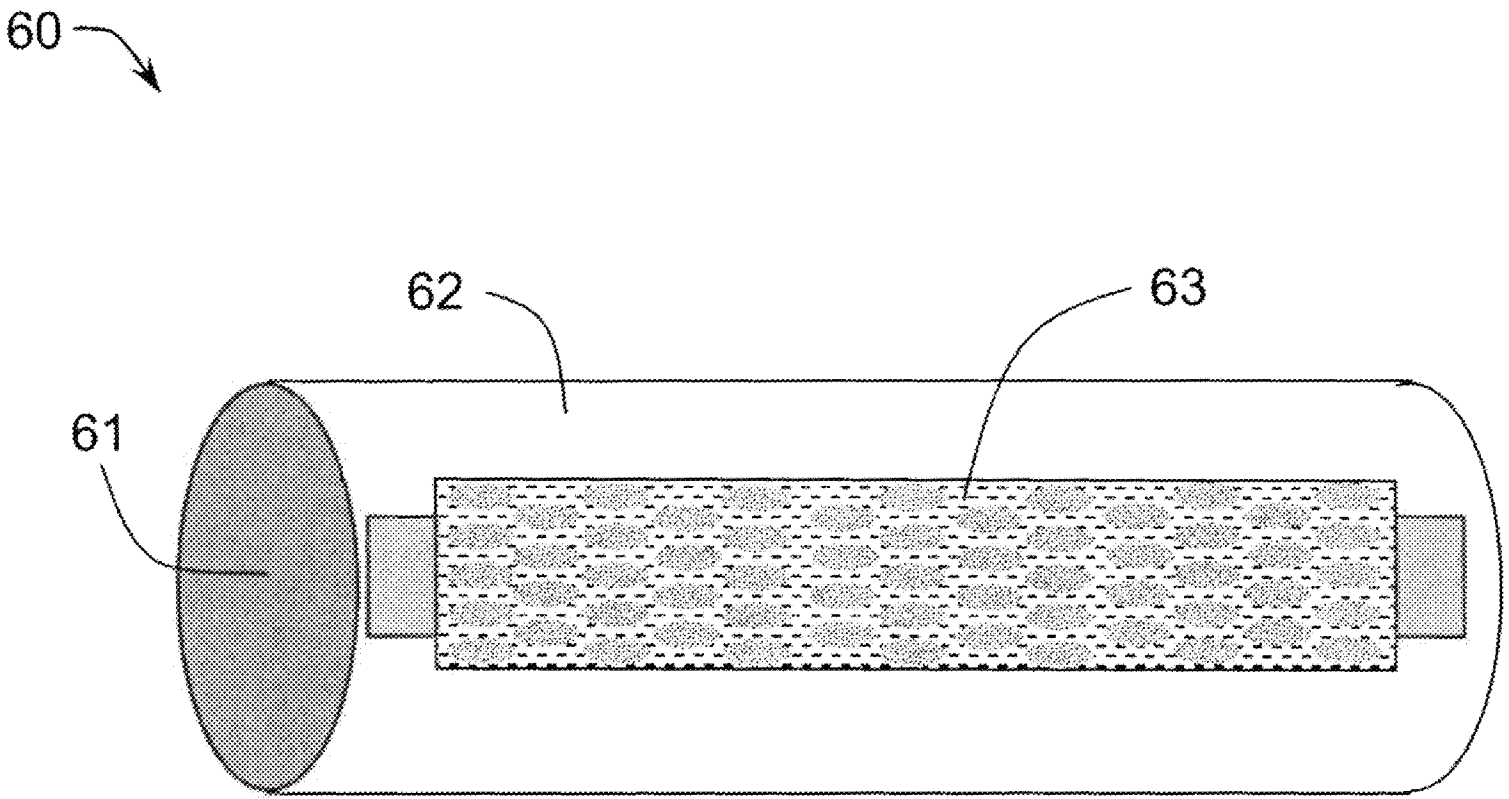
FIG. 7 is a schematic representation of a non-limiting embodiment of a grinding roll according to the present disclosure, comprising a wear resistant article removably mounted to a surface of the roll.

Referring now to FIGS. 3A, 3B, and 7, an aspect of this disclosure is directed to embodiments of a grinding roll 60 for the comminution of granular materials. In a non-limiting embodiment, a grinding roll 60 comprises a cylindrical core 61, which has an external peripheral surface 62. In certain non-limiting embodiments, the grinding roll 60 may be comprised of a steel alloy or other material known to be suitable for pressure rolling of granular material. At least one wear resistant article 63 according to the present disclosure that is adapted for use as at least a portion of a wear resistant working surface of the grinding roll 60 is removably attached to the external peripheral surface 62 of the grinding roll 60.

The wear resistant article 63 may comprise a metal matrix composite 21 including a plurality of inorganic particles 22 dispersed in a matrix material 23. The matrix material 23 may comprise a metal or metal alloy having a melting temperature that is less that the melting temperature of the inorganic particles. A plurality of hard elements 24 may be interspersed in and bonded together by the metal matrix composite 21 of the wear resistant article 63. In an embodiment, the wear resistance of the metal matrix composite 21 is less than a wear resistance of the hard elements 24, and the metal matrix composite 21 preferentially wears away when the grinding roll 60 is in use, thereby providing or preserving gaps 25 between a plurality of the hard elements 24 at a surface 26 of the article 63.

The hard elements 24 of the wear resistant article 63 of the grinding roll 60 may include materials comprising, but not limited to, at least one of a high hardness metal, a high hardness metal alloy, a sintered cemented carbide, and a ceramic. In a non-limiting embodiment, the hard elements comprise a high hardness metal alloy that is a tool steel. In another non-limiting embodiment, each of the plurality of hard elements 24 of the wear resistant article 63 comprises a sintered cemented carbide.

In a non-limiting embodiment, the plurality of hard elements 24 of the wear resistant article 63 secured to grinding roll 60 comprise a first end 27 and a opposed second end 28, wherein the first end 27 and opposed second end 28 are substantially planar and substantially parallel to each other, and wherein for each hard element 24 a distance between the first end 27 and the opposed second end 28 is substantially the same.

The inorganic particles 22 of the wear resistant article 63 of the grinding roll 60, in a non-limiting embodiment, comprise a metal powder or a metal alloy powder, which may be selected from, but is not limited to, at least one of tungsten, a tungsten alloy, tantalum, a tantalum alloy, molybdenum, a molybdenum alloy, niobium, a niobium alloy, iron, an iron alloy, titanium, a titanium alloy, nickel, a nickel alloy, cobalt, and a cobalt alloy. In another non-limiting embodiment, the inorganic particles 22 comprise hard particles, which may include, but are not limited to, at least one of a carbide, a boride, an oxide, a nitride, a silicide, a sintered cemented carbide, a synthetic diamond, and a natural diamond.

A grinding roll 60 may include a wear resistant article 63 comprising a matrix material 23 that includes, but is not limited to at least one of copper, a copper alloy, aluminum, an aluminum alloy, iron, an iron alloy, nickel, a nickel alloy, cobalt, a cobalt alloy, titanium, and a titanium alloy.

In certain non-limiting embodiments, the hard elements 24 of the wear resistant article 63 are spaced in a predetermined pattern in the metal matrix composite 21. In other embodiments, not meant to be limiting, the hard elements 24 of the wear resistant article 63 comprise 25% to 95%, or 40% to 90%, or 50% to 80% of the projected surface area of the surface 26 of the wear resistant article 63.

The wear resistant article 63 may further comprise at least one machinable region 29 bonded to the article 63 by the metal matrix composite 21. The one or more machinable regions 29 may comprise at least one of iron, an iron alloy, nickel, a nickel alloy, cobalt, a cobalt alloy, copper, a copper alloy, aluminum, an aluminum alloy, tantalum, and a tantalum alloy. In a non-limiting embodiment, the machinable areas 29 of the wear resistant article 63 are removably attached to the external peripheral surface 62 of the grinding roll 60 by any means now or hereafter known to a person having skill in the art, including, but not limited to mechanical clamping, brazing, welding, and adhesives (including, but not limited to, epoxies). The provision of one or more machinable regions 29 of the wear resistant article 63, and the possibility of using many means to attach the machinable regions 29 (and thus the article 63) to the external peripheral surface 62 of a grinding roll 60, permits an article according to the present disclosure to be used with cylindrical grinding roll cores made from a variety of materials.

Figure 1:
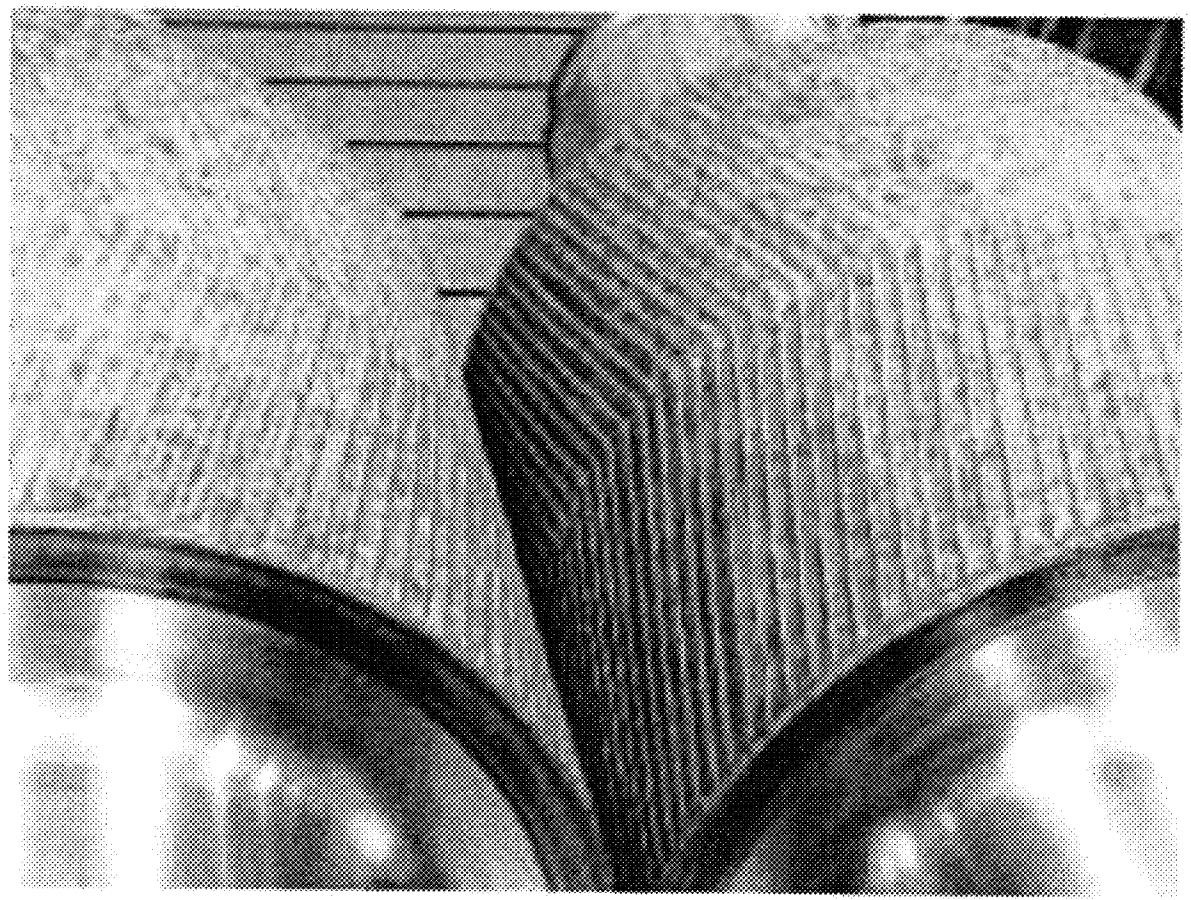
PRIOR ART FIG. 1
FIG. 1 is a photograph of a prior art grinding roll having a welded surface.
Figure 2:
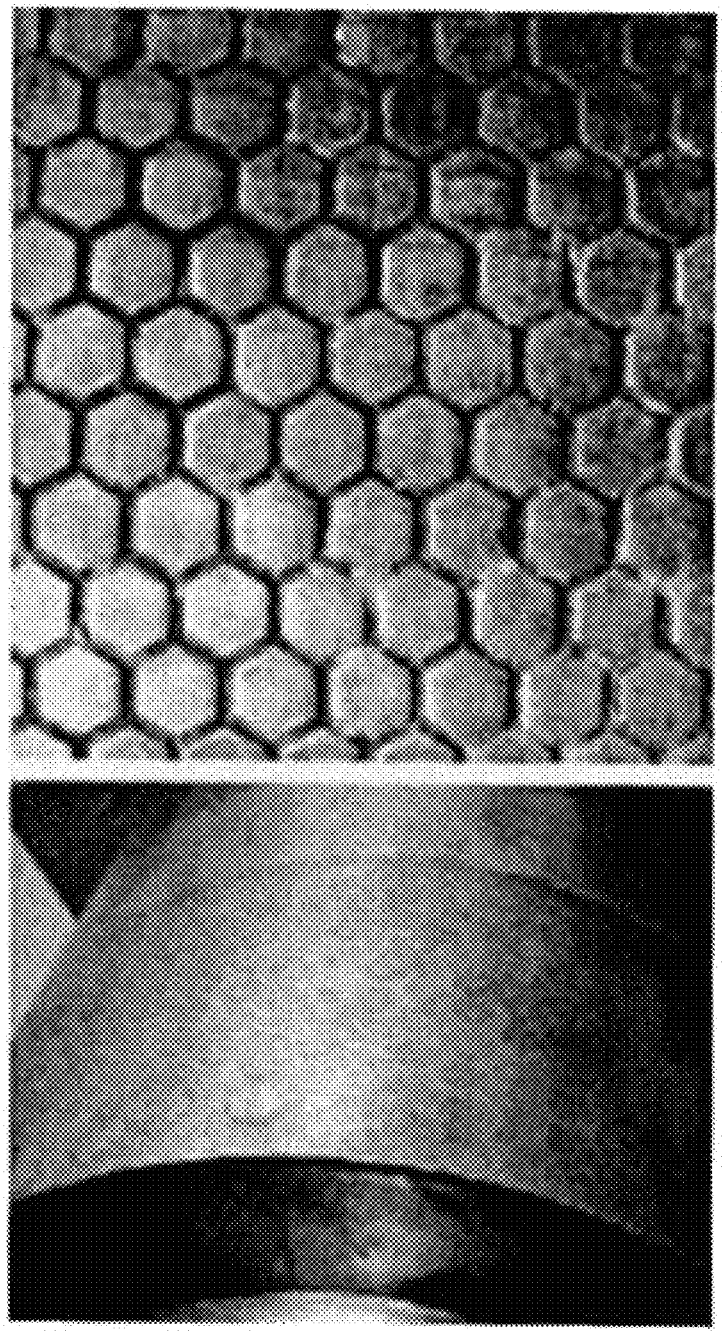
PRIOR ART FIG. 2
FIG. 2 depicts photographs of a prior art grinding roll including welded projections comprising hard elements and gaps between the projections.

A method of one of manufacturing and maintaining a grinding roll according to the present disclosure comprises providing a cylindrical core 61 comprising an external peripheral surface 62, and attaching embodiments of the article 20 disclosed in FIGS. 2A and 2B and hereinabove to the surface 62. The article 20 may be attached to the external peripheral surface 62 of the grinding roll 60 by mechanical clamping, brazing, welding, and/or adhesives (such as but not limited to epoxies), or by any suitable means known to a person skilled in the art.

EXAMPLE 1

Hard elements comprised of a sintered cemented carbide prepared from Grade 231 cemented carbide powder, available from ATI Firth Sterling, Madison, Ala., were prepared using conventional powder metallurgy techniques, including the steps of powder compaction and high temperature sintering. Grade 231 cemented carbide powder is a mixture of 10 percent by weight of cobalt powder and 90 percent by weight of tungsten carbide powder. Powder compaction was performed at a pressure of 206.8 MPa (15 tons per square inch). Sintering was conducted at 1400° C. (2552° F.) in an over pressure furnace using argon gas at a pressure of 5.52 MPa (800 psi). The sintered cemented carbide prepared with Grade 231 powder typically has a hardness of 87.5 HRA and a density of 14.5 g/cm$^3$. The hard elements had a form of substantially fiat bottomed cylinders. A mold adapted to form articles having the shape of a square plate was machined from graphite. The cylindrical cemented carbide parts were placed on the bottom of a mold cavity of the mold. The unoccupied volume in the mold, i.e., the space between the sintered cemented carbide hard elements within the mold cavity, was filled with a blend of 50 percent by weight of cast tungsten carbide powder and 50 percent by weight of nickel powder. A graphite funnel was placed on top of the mold assembly and bronze pellets were placed in the funnel. The bronze pellets had a composition of 78 weight percent copper, 10 weight percent nickel, 6 weight percent manganese, 6 weight percent tin, and incidental impurities. The entire assembly was disposed for 60 minutes in an air atmosphere in a preheated furnace maintained at a temperature of 1180° C. (2156° F.). The bronze melted and infiltrated the space between the cast tungsten carbide powder, the nickel powder, and the hard elements. The mold was allowed to cool, thereby allowing a metal matrix composite to form comprising the cast tungsten carbide particles in a matrix material comprising bronze and nickel. The cylindrical cemented carbide parts were embedded within the metal matrix composite. The wear resistant article was removed from the mold cavity and was cleaned, and excess material was removed from the article by machining.

EXAMPLE 2

Figure 8:
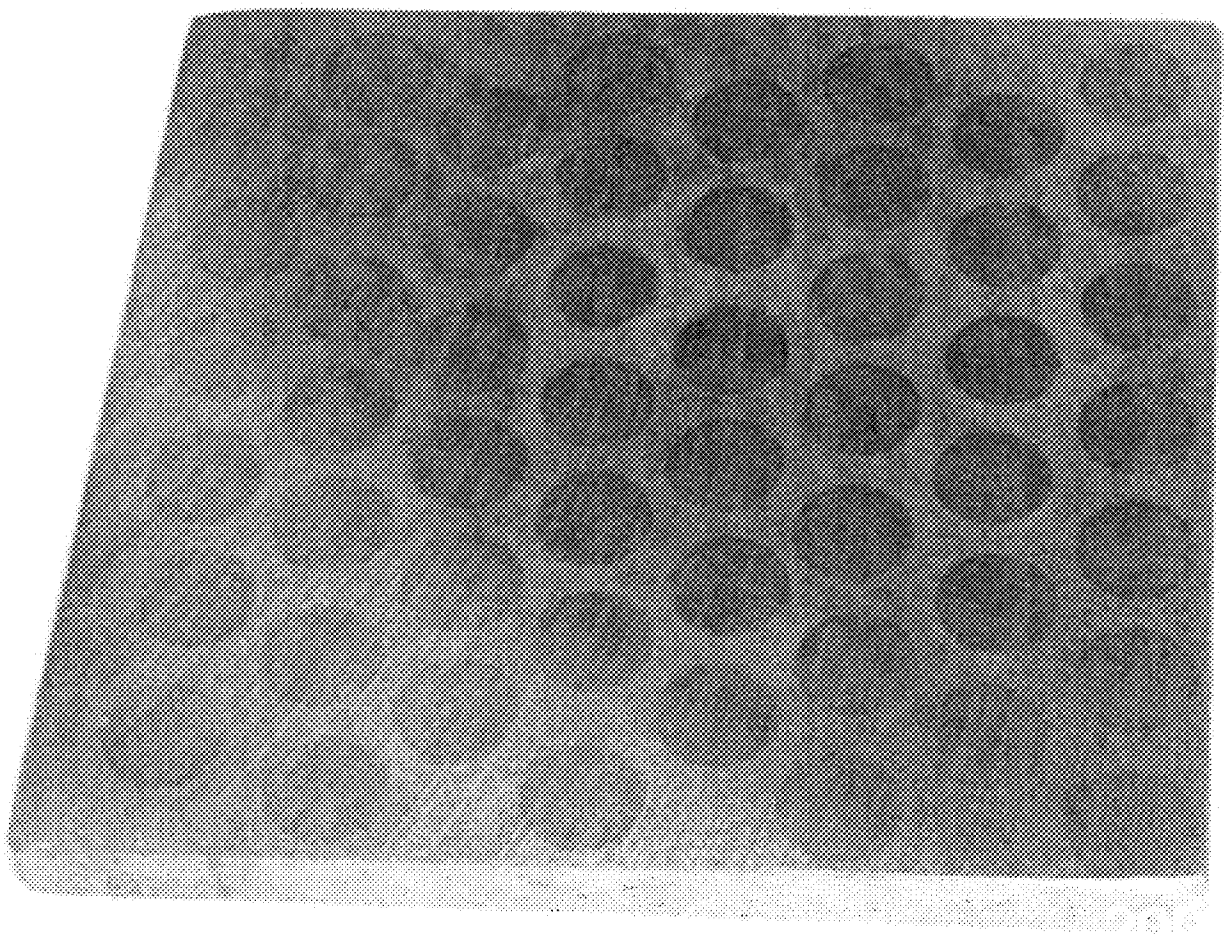
FIG. 8 is a photograph of a non-limiting embodiment of a wear resistant article according to the present disclosure.

A photograph of the article fabricated in Example 1 is presented in FIG. 8. The dark circular regions of the article are the hard elements. The hard elements are surrounded by and bonded into the article by the lighter appearing metal matrix composite. The article may be hot worked or otherwise suitably processed to include a curvature matching the curvature of a peripheral surface of a roll, and then may be secured to the roll surface by welding or another suitable means.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. An article in the form of one of a plate, a sheet, a cylinder, and a portion of a cylinder, the article adapted for use as at least a portion of a wear resistant working surface of a roll, the article comprising:

a metal matrix composite comprising a plurality of inorganic particles dispersed in a matrix material comprising at least one of a metal and a metal alloy, a melting temperature of the inorganic particles being greater than a melting temperature of the matrix material; and a plurality of hard elements interspersed in the metal matrix composite;

wherein a wear resistance of the metal matrix composite is less than a wear resistance of the hard elements; and wherein the metal matrix composite preferentially wears away when the article is in use, thereby providing or preserving a gap between each of the plurality of hard elements at a working surface of the article.

2. The article of claim 1, wherein the hard elements comprise at least one of a high hardness metal, a high hardness metal alloy, a sintered cemented carbide, and a ceramic material.

3. The article of claim 1, wherein each of the hard elements comprise at least one of a high hardness metal and a high hardness metal alloy.

4. The article of claim 1, wherein each of the hard elements comprises a sintered cemented carbide.

5. The article of claim 4, wherein the sintered cemented carbide comprises particles of at least one carbide of a Group IVB, a Group VB, and a Group VIB metal of the Periodic Table dispersed in a continuous binder comprising at least one of cobalt, a cobalt alloy, nickel, a nickel alloy, iron, and an iron alloy.

6. The article of claim 1, wherein the hard elements are spaced apart in the article in a predetermined pattern.

7. The article of claim 1, wherein the plurality of hard elements comprises a first end and an opposed second end;

wherein the first end and the opposed second end oppose each other and are substantially equidistant from each other on each of the plurality of hard elements.

8. The article of claim 7, wherein the first end and the opposed second end of each of the hard elements are substantially planar and are substantially parallel to each other.

9. The article of claim 8, wherein each of the plurality of hard elements comprises a cylindrical shape.

10. The article of claim 1, wherein the inorganic particles comprise at least one of a metal powder and a metal alloy powder.

11. The article of claim 10, wherein the inorganic particles comprise at least one of tungsten, a tungsten alloy, tantalum, a tantalum alloy, molybdenum, a molybdenum alloy, niobium, a niobium alloy, iron, an iron alloy, titanium, a titanium alloy, nickel, a nickel alloy, cobalt, and a cobalt alloy.

12. The article of claim 1, wherein the inorganic particles comprise hard particles.

13. The article of claim 12, wherein the hard particles comprise at least one of a carbide, a boride, an oxide, a nitride, a silicide, a sintered cemented carbide, a synthetic diamond, and a natural diamond.

14. The article of claim 12, wherein the hard particles comprise at least one of: a carbide of a metal selected from Groups IVB, VB, and VIB of the Periodic Table; tungsten carbide; and cast tungsten carbide.

15. The article of claim 1, wherein the matrix material comprises at least one of copper, a copper alloy, aluminum, an aluminum alloy, iron, an iron alloy, nickel, a nickel alloy, cobalt, a cobalt alloy, titanium, a titanium alloy, a bronze alloy, and a brass alloy.

16. The article of claim 15, wherein the matrix material is a bronze alloy consisting essentially of 78 weight percent copper, 10 weight percent nickel, 6 weight percent manganese, 6 weight percent tin, and incidental impurities.

17. The article of claim 15, wherein the matrix material consists essentially of 53 weight percent copper, 24 weight percent manganese, 15 weight percent nickel; 8 weight percent zinc, and incidental impurities.

18. The article of claim 1, further comprising at least one machinable region bonded to the article by the metal matrix composite.

19. The article of claim 18, wherein the at least one machinable region comprises at least one of iron, an iron alloy, nickel, a nickel alloy, cobalt, a cobalt alloy, copper, a copper alloy, aluminum, an aluminum alloy, tantalum, and a tantalum alloy.

20. The article of claim 18, wherein the machinable region comprises particles of at least one of iron, an iron alloy, nickel, a nickel alloy, cobalt, a cobalt alloy, copper, a copper alloy, aluminum, an aluminum alloy, tantalum, and a tantalum alloy joined together by the matrix material.

21. The article of claim 18, wherein the machinable region is adapted for fixturing the article to a surface of a roll.

22. The article of claim 3, wherein each of the hard elements comprises a tool steel.

23. The article of claim 1, wherein each of the hard elements comprises a ceramic material.

24. The article of claim 23, wherein each of the hard elements comprises at least one of a silicon nitride reinforced with silicon carbide whiskers and an aluminum oxide reinforced with silicon carbide whiskers.

* * * * *